US007448591B2

(12) United States Patent
Ross

(10) Patent No.: US 7,448,591 B2
(45) Date of Patent: Nov. 11, 2008

(54) STEP RATCHET MECHANISM

(75) Inventor: Richard J. Ross, Houston, TX (US)

(73) Assignee: BJ Services Company, Houston, TX (US)

( * ) Notice: Subject to any disclaimer, the term of this patent is extended or adjusted under 35 U.S.C. 154(b) by 0 days.

(21) Appl. No.: 11/824,936

(22) Filed: Jul. 3, 2007

(65) Prior Publication Data

US 2008/0001111 A1 Jan. 3, 2008

Related U.S. Application Data

(60) Provisional application No. 60/818,425, filed on Jul. 3, 2006.

(51) Int. Cl.
*F16K 31/44* (2006.01)

(52) U.S. Cl. ..... 251/62; 166/332.1; 251/230

(58) Field of Classification Search ..... 251/62–63.6, 251/230; 166/332.1
See application file for complete search history.

(56) References Cited

U.S. PATENT DOCUMENTS

| | | | | | |
|---|---|---|---|---|---|
| 2,815,925 | A | | 12/1957 | Fisher | 251/347 |
| 4,058,165 | A | | 11/1977 | Holden et al. | 166/314 |
| 4,109,725 | A | * | 8/1978 | Williamson et al. | 251/62 |
| 4,113,012 | A | * | 9/1978 | Evans et al. | 251/63 |
| 4,289,200 | A | | 9/1981 | Fisher | 166/120 |
| 4,420,044 | A | * | 12/1983 | Pullin et al. | 251/230 |
| 4,458,762 | A | * | 7/1984 | McMahan | 251/54 |
| 4,842,057 | A | | 6/1989 | Lubitz | 166/51 |
| 4,862,957 | A | * | 9/1989 | Scranton | 166/51 |
| 4,967,845 | A | * | 11/1990 | Shirk | 251/58 |
| 5,230,383 | A | * | 7/1993 | Pringle et al. | 251/129.21 |
| 5,984,014 | A | * | 11/1999 | Poullard et al. | 166/374 |
| 6,085,845 | A | * | 7/2000 | Patel et al. | 251/54 |
| 6,109,354 | A | | 8/2000 | Ringgenberg et al. | 166/374 |
| 6,223,824 | B1 | * | 5/2001 | Moyes | 166/332.1 |
| 2005/0077053 | A1 | | 4/2005 | Walker et al. | 166/387 |

FOREIGN PATENT DOCUMENTS

| | | | |
|---|---|---|---|
| EP | 0068985 | A | 1/1983 |
| EP | 0435856 | A | 7/1991 |
| GB | 846859 | A | 8/1960 |
| GB | 2394735 | A | 5/2004 |
| WO | WO 01/88328 | A | 11/2001 |

OTHER PUBLICATIONS

International Search Report and Written Opinion dated Nov. 28, 2007, for PCT Application No. PCT/US2007/015478, filed Jul. 3, 2007.

* cited by examiner

*Primary Examiner*—John Bastianelli
(74) *Attorney, Agent, or Firm*—Howrey LLP

(57) ABSTRACT

A step ratchet mechanism that allows for the incremental movement of an assembly that may be adapted to incrementally open or close an adjustable orifice. The step ratchet mechanism may be comprised of a modified body lock ring that permits incremental movement along a mandrel in either direction along the mandrel. The step ratchet mechanism may be actuated a designated distance by the application of pressure to the mechanism. The step ratchet mechanism may be ideal for using pressure to drive a downhole multi-position device. The modified body lock ring is adapted to both secure the mechanism at each set position as the mandrel is pumped down as well as allowing the mechanism to ratchet when the mandrel is pumped back.

33 Claims, 20 Drawing Sheets

STEP RATCHET MECHANISM

This application is a non-provisional application claiming priority to U.S. Provisional Application Ser. No. 60/818,425, entitled "STEP RATCHET MECHANISM" by Richard J. Ross, filed Jul. 3, 2006.

BACKGROUND OF THE INVENTION

1. Field of the Invention

The present invention relates generally to a step ratchet mechanism that may be ideal for driving a multi-position device, such as an adjustable orifice. The step ratchet mechanism allows for the multi-position device to be moved a predetermined incremental distance each time the step ratchet mechanism is cycled. The movement of an incremental distance may allow the incremental opening of an adjustable orifice to pressure test the seals before completely opening the orifice. The distance the multi-position device is driven per cycling of the step ratchet mechanism may be modified by the adapting the physical dimensions of the step ratchet mechanism components as would be recognized by one of ordinary skill in the art having the benefit of this disclosure. The step ratchet mechanism may include a body lock ring or a body lock collet that locks the mechanism to a mandrel as the step ratchet mechanism moves during each cycle. The body lock ring or body lock collet may be adapted to also allow movement of the step ratchet mechanism in the opposite direction along the mandrel.

2. Description of the Related Art

The use of a body lock ring is a well known to lock a downhole assembly to a mandrel. Current body lock rings generally allow the assembly to travel along a mandrel in one direction, locking the assembly down to the mandrel each time the assembly stops moving. Body lock rings generally allow the assembly to be ratcheted along the mandrel in one direction, but typically are designed to lock the assembly to the mandrel and thus, do not allow the assembly to travel or ratchet in the other direction along the mandrel. This function of the body lock ring is often acceptable as the purpose of the body lock ring is to secure the downhole assembly to the mandrel. The current designs utilizing body lock rings do not allow the assembly to move along the mandrel in the opposition direction if so desired. If the downhole assembly needs to be removed from the mandrel, the downhole assembly and body lock ring may have to be drilled out of the wellbore.

The one-direction ratcheting nature of the body lock ring has limited its use to applications that only require movement in one direction. It would be beneficial to provide a device that ratchets or moves incrementally in one direction securing a downhole assembly to a structure such as a mandrel, but that also allows the downhole assembly to move along the structure in the opposite direction when so desired. For example, such a device may be useful in conjunction with a flow orifice. Downhole orifices are often used to regulate the amount of flow from a particular zone as excessive flow rates can cause formation damage or produce sand. Current body lock rings may be applicable to be used in such an instance. However, it would also be desirable to close the flow orifice if need be, which is not possible with current body lock ring designs. A device that allows incremental movement to open a flow orifice locking the flow orifice in place between incremental movements, but also while allowing movement in the opposite direction to also close the flow orifice would be beneficial.

In light of the foregoing, it would be desirable to provide a mechanism that provides for incremental movement in a first direction along a mandrel, secures an assembly to the mandrel, and also allows for movement of the mechanism in a second direction along the mandrel. It would be further desirable to provide a body lock ring that is adapted to both lock an assembly against a mandrel and also allow the body lock ring to release from the mandrel allowing the body lock ring and any connected assembly to travel along the mandrel. It would also be desirable to provide a mechanism that may be used to incrementally drive a multi-position device, such as an adjustable orifice, in one direction that also allows the movement of the multi-position device in the opposite direction while preventing movement of the orifice.

The present invention is directed to overcoming, or at least reducing the effects of, one or more of the issues set forth above.

SUMMARY OF THE INVENTION

In one embodiment, a step ratchet mechanism is provided to incrementally move a downhole assembly, the mechanism comprising a movable piston, a mandrel, a body lock ring adapted to selectively engage the mandrel, a body lock ring carrier connected to the body lock ring, a spring lock positioned adjacent to the body lock ring carrier, a spring holder wherein a portion of the spring lock is positioned within the spring holder, and a spring located within the spring holder, wherein movement of the movable piston contacts the body lock ring carrier engaging the body lock ring with the mandrel and moving the mandrel, body lock ring, body lock ring carrier, and spring lock until the spring is completely compressed within the spring holder. The mechanism may include a lower adapter that is positioned such to prevents the movement of the spring holder past the lower adapter.

In one embodiment, pressure may be applied to the mechanism to move of the piston downward until the spring holder contacts the lower adapted and the spring is completely compressed within the spring holder. Upon release of the pressure on from the mechanism, the compressed spring may move the spring lock, the body lock ring carrier, and the body lock ring upwards along the mandrel as the spring moves back to its uncompressed state. The body lock ring is adapted to allow upward movement along the mandrel as the spring moves back to its uncompressed state. Friction may prevent the upward movement of the mandrel when the pressure is released from the mechanism allowing the spring to uncompress. Alternatively, a mechanism may be used to prevent movement of the mandrel due to the uncompression of the spring. Although the above embodiment is discussed in regards to the downward movement of the mandrel and body lock ring assembly until the spring is completely compressed and the upwards movement of the body lock ring assembly due to the expansion of the spring to its uncompressed state, the disclosed embodiment may be adapted to incrementally move the mandrel and the body lock ring assembly in any relative direction and allow the movement of the body lock ring assembly in the opposite direction due to the uncompression of the spring as would be appreciated by one of ordinary skill in the art having the benefit of this disclosure.

In one embodiment, a step ratchet mechanism to incrementally move a downhole assembly is provided wherein the mechanism comprises a movable piston, a mandrel, a body lock collet adapted to selectively engage the mandrel, a body lock collet carrier connected to the body lock collet, a spring lock positioned adjacent to the body lock collet carrier, a spring holder wherein a portion of the spring lock is positioned within the spring holder, and a spring located within the spring holder, wherein movement of the movable piston in a first direction contacts the body lock collet carrier engaging the body lock collet with the mandrel and moving the mandrel, body lock collet, body lock collet carrier, and spring lock in the first direction until the spring is fully compressed within the spring holder. The mechanism may include a lower adapter that is positioned such to prevents the movement of the spring holder past the lower adapter.

Pressure may be applied to the mechanism to move of the piston in the first direction until the spring holder contacts the lower adapted and the spring is completely compressed within the spring holder. Upon release of the pressure on the mechanism, the compressed spring may move the spring lock, the body lock collet carrier, and the body lock collet in a second direction along the mandrel upon the release of the pressure from the mechanism. The body lock collet may be adapted to allow movement in the second direction along the mandrel. Friction may prevent the movement of the mandrel in the second direction when the pressure is released from the mechanism and the spring returns to its uncompressed state. Alternatively, a mechanism may be used to prevent movement of the mandrel in the second direction due to the uncompression of the spring.

In one embodiment, a step ratchet mechanism to incrementally move a downhole assembly is provided wherein the mechanism comprises a piston movable within a chamber of the mechanism, a mandrel, a double ended body lock collet adapted to selectively engage the mandrel, a body lock collet carrier connected to the body lock collet, a spring located within the chamber, and a cylinder positioned adjacent to a first end of the spring, wherein movement of the movable piston in a first direction contacts the body lock collet carrier engaging the body lock collet with the mandrel and moving the mandrel, the body lock collet, and the body lock collet carrier in the first direction until the spring is fully compressed by the cylinder within the chamber. The mechanism may include a friction ring and a beveled ring positioned adjacent to a second end of the spring. The friction ring may be a split ring that is pushed against the mandrel by the beveled ring upon compression of the spring within the chamber. The mechanism may include a lower adapter that is positioned adjacent to the beveled ring to prevent movement of the beveled ring. The friction ring and beveled ring prevent movement of the mandrel when pressure is released and the spring returns to its uncompressed state.

One embodiment of the present disclosure is a body lock ring for use in a step ratchet mechanism, the body lock ring comprising a ring having an inner surface and an outer surface, the ring including a longitudinal gap. The body lock ring further comprising teeth on the exterior surface, the teeth adapted to engage teeth located on the interior of a body lock ring carrier. The body lock ring further comprising teeth on the interior surface, the teeth adapted to selectively engage teeth located on the exterior of a mandrel, wherein the interior teeth of the body lock ring are adapted to selectively engage the teeth on the exterior of the mandrel in a first direction and to allow the body lock ring to move along the mandrel in a second direction.

One embodiment of the present disclosure is a body lock collet for use in a step ratchet mechanism, the body lock collet being comprised of a collet having collet fingers that have an inner surface and an outer surface. The collet fingers are positioned longitudinally around the perimeter of the collet. The number of collet fingers may be varied between applications as would be recognized by one of ordinary skill in the art having the benefit of this disclosure. The collet fingers further comprise teeth on the exterior surface, the teeth being adapted to engage teeth located on the interior surface of a body lock collet carrier. The collet fingers further comprise teeth on the interior surface, the teeth adapted to selectively engage teeth located on the exterior of a mandrel, wherein the interior teeth of the collet fingers are adapted to selectively engage the teeth on the exterior of the mandrel in a first direction and to allow the body lock collet to move along the mandrel in a second direction. The length of the collet fingers may be varied changing the requisite spring constant of compression spring used in the ratchet mechanism as would be appreciated by one of ordinary skill in the art having the benefit of this disclosure.

One embodiment of the present disclosure is the method of incrementally moving a multi-position device comprising the step of applying pressure to the device, wherein the pressure moves a piston from an initial position in a first direction within the device, the piston moving an assembly in the first direction, the assembly comprising a body lock ring, a body lock ring carrier, and a spring cartridge containing a spring, wherein the body lock ring engages a mandrel in an initial position such that movement of the assembly in the first direction provides movement of the mandrel in the first direction away from the initial position. The method includes the step of increasing the pressure on the device until the assembly moves an initial distance in the first direction fully compressing the spring within the spring cartridge and the step of releasing the pressure from the device, wherein the spring expands moving the assembly in a second direction. The method includes the step of holding the mandrel to prevent movement in the second direction upon the release of pressure from the device. In one embodiment, a mechanism may be used to prevent the movement of the mandrel in the second direction. Alternatively, friction alone may be used to prevent the movement of the mandrel in the second direction.

The method of incrementally moving a multi-position device may further comprising the step of re-applying pressure to the device, wherein the pressure moves the piston in the first direction within the device moving the assembly and the mandrel in the first direction and the step of increasing the pressure on the device until the assembly and the mandrel moves an incremental distance in the first direction fully compressing the spring within the spring cartridge. The method may includes the step of releasing the pressure from the device, wherein the spring expands to the uncompressed state moving the assembly in a second direction and the step of holding the mandrel after moving the incremental distance in the first direction to prevent movement in the second direction upon the release of pressure from the device. The method may include repeating the steps of re-applying pressure to the device, releasing the pressure from the device, and holding the mandrel until the mandrel has reached a final position in the first direction. In one embodiment, the mandrel of the disclosed method may include a portion adapted to contact the piston when the mandrel of the device has incrementally moved to the final position in the first direction. The method may further include the steps of back pressuring the device such that the piston moves in the second direction within the device until the piston returns to its initial position. The piston may pull the mandrel and body lock ring assembly back to the initial position by contacting a stop or catch located on the mandrel. Alternatively, the piston may only position the mandrel in its initial position and the back pressure may cause the body lock ring assembly to move in the second direction back to its original position.

One embodiment of the present disclosure is the method of incrementally adjusting a flow orifice comprising the steps of applying pressure to a step mechanism, the step mechanism comprising a body lock ring assembly, a spring cartridge having a compression spring, and a mandrel all positioned in an initial position such that the flow orifice is completely closed, wherein the initial application of pressure moves the body lock ring assembly, the spring cartridge, and the mandrel an initial distance in a first direction until the spring cartridge contacts a stop, the movement of the mandrel the initial distance opening the flow orifice an initial distance. The method further comprising the step of increasing the pressure on the step mechanism until the body lock assembly and mandrel moves an incremental distance in the first direction fully compressing the spring within the spring cartridge, mandrel incrementally opening the flow orifice. The method further comprising the step of releasing the pressure from the step mechanism, wherein the spring moves to an uncompressed state moving the body lock assembly in a second direction. The method further comprising the step of holding the mandrel to prevent movement in the second direction upon the release of pressure from the device, wherein the flow orifice remains in its partially opened state.

Applying and releasing the pressure on the step mechanism, wherein each application of pressure moves the body lock assembly and the mandrel the incremental distance in the first direction to compress the spring in the spring cartridge and upon releasing the pressure the spring uncompressed moving the body lock assembly along the mandrel in the second direction, wherein the incremental movement of the mandrel in the first direction incrementally opens the flow orifice. The method further comprises cycling the pressure on the step mechanism until the flow orifice is completely opened. The method may further include the step of applying back pressure to the step mechanism, wherein the back pressure moves the piston to its original position. The mandrel may include a stop or catch, wherein the piston contacts the stop or catch moving the mandrel back to its original position.

One embodiment of the present disclosure is a body lock ring having outer teeth and inner teeth, wherein the outer teeth include a vertical face that engages teeth on a body lock ring carrier and the inner teeth include a face that engages teeth on a mandrel. The vertical face of the outer teeth is preferably 90 degrees from the horizontal plane of the outer teeth, but may be varied from between approximately 80 degrees and 95 degrees from the horizontal plane of the outer teeth. The face of the inner teeth has been swept back to allow the body lock ring to ratchet along the mandrel. Specifically, the face of the inner teeth has been swept back until the face is less than approximately 70 degrees from the horizontal plane of the inner teeth. In order for the body lock ring to clamp to the mandrel, the pitch angle of the outer teeth from the horizontal plane is preferably at least 20 degrees less that the angle from the swept back face to the horizontal plane of the inner teeth. The pitch angle of the inner teeth is preferably at least 20 degrees less from the horizontal plane of the inner teeth than the angle of the vertical face of the outer teeth. Additionally, the pitch angle of the inner teeth is preferably less than 70 degrees from the horizontal plane of the inner teeth. A similar configuration may also be utilized for the inner and outer teeth for a body lock collet, along with the corresponding teeth on the mandrel and collet carrier, according to the present invention.

Figure 1:
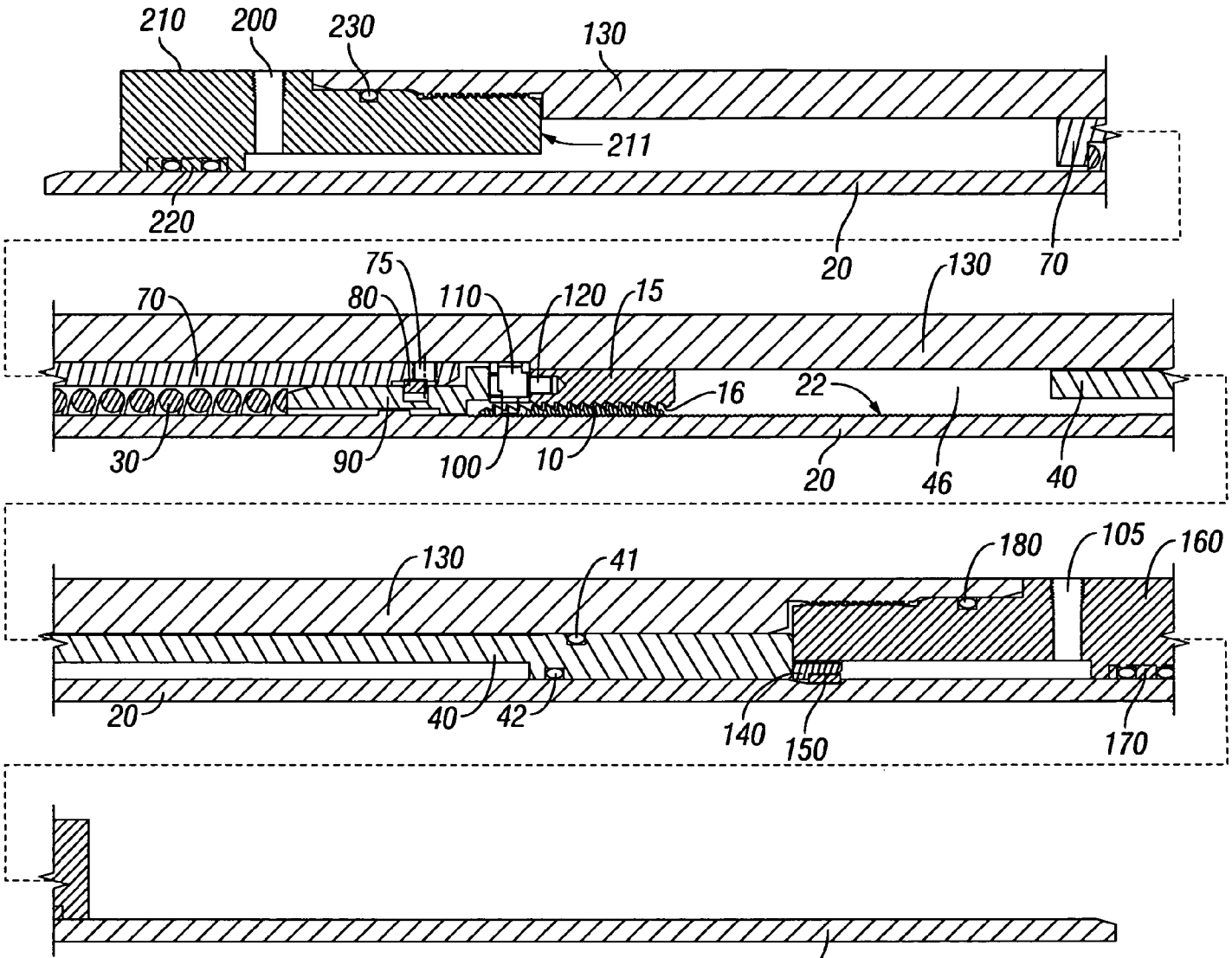
FIG. 1 is cross-section view of one embodiment of a step ratchet mechanism that includes a body lock ring 10.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the use of a step ratchet mechanism adapted to incrementally drive a downhole assembly. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

FIG. 1 shows one embodiment of the step ratchet mechanism that uses a body lock ring 10 that engages a body lock ring carrier 15 and selectively engages a mandrel 20. The body lock ring 10 includes inner teeth 12 (shown in FIG. 5) that selectively engage the teeth 22 located on the outside of the mandrel 20 and the body lock ring 10 includes outer teeth 11 (shown in FIG. 5) that engage the teeth 16 on the interior of the body lock ring carrier 15. The inner teeth 12 of the body lock ring 10 are adapted to allow the body lock ring 10 to ratchet in one direction along the mandrel 20 and also move along the mandrel 20 in the opposite direction when a back pressure is applied to the mechanism as described below.

The step ratchet mechanism includes a piston 40 positioned in a chamber 46 located between the mandrel 20 and a top connector 130. At one end of the chamber 46, is an upper adapter 160 and at the other end of the chamber 46 is a lower adapter 210. The piston 40 is movable within the chamber 46 and includes an upper sealing element 41, such as an o-ring, to seal with the top connector 130. The piston 40 also includes a lower sealing element 42, such as an o-ring, that seals the orifice between the piston 40 and the mandrel 20. In the initial state of the step ratchet mechanism, the upper portion of the piston 40 is located adjacent to the lower portion the upper adapter 160.

The upper adapter 160 interfaces with the top connector 130 and the mandrel 20. The upper adapter 160 may include an upper sealing element 180, such as an o-ring, to seal the interface with the top connector 130 and a lower sealing element 170, such as a standard chevron, that seals the interface with the mandrel 20. The upper adapter 160 includes an upper port 105, which allows for pressure to be applied to the system. The lower adapter 210 is located at the other end of the top connector 130 and includes a sealing element 230, such as an o-ring, located between the connection interface. The lower adapter 210 includes a fluid port 200 and interfaces with the mandrel 20, which may include a sealing element 220, such as a standard chevron, between the interface. The embodiment may include a lock ring holder 140 and a ratchet lock ring 150 both positioned between the mandrel 20 and the upper adapter 160. The ratchet lock ring 150 may be a split snap ring that snaps into a groove (not shown) on the mandrel 20. The long ring holder 140 is a snap ring retainer that helps secure the ratchet lock ring 150 to the mandrel. The ratchet lock ring 150 provides an upset for the piston 40 to contact to move the mandrel 20 back to its original position as detailed below.

The application of pressure through the upper port 105 causes the piston 40 to move along the chamber 46 between the top connector 130 and the mandrel 20 moving away from the upper adapter 160. The piston 40 will contact the upper portion of body lock ring carrier 15 pushing the assembly of the body lock ring carrier 15 and the body lock ring 10 in the same direction as the piston. As pressure is applied to the system, the body lock ring 10 is pushed against the mandrel 20 such that the teeth 12 engage (shown in FIGS. 5 and 6) the teeth 22 located on the exterior of the mandrel 20. Thus, the movement of the body lock ring 10 away from the upper adapter 160 also moves the mandrel 20 away from the upper adapter 160.

The initial application of pressure causes the movement of the body lock ring holder 110 until it is positioned adjacent to a spring lock 90. The spring lock 90 is positioned adjacent to a spring 30 located within a spring holder 70. Snap ring 80 holds spring holder 70 and spring lock 90 together and maintains a pre-load on spring 30. Hole 75 provides access to snap ring 80 for assembly purposes. The movement of the piston 40 causes the movement of the body lock ring assembly and the spring lock 90 to move away from the upper adapter 160 until the lower portion of the spring holder 70 contacts the shoulder 211 of the lower adapter 210.

Once the spring lock 90 contacts the shoulder 211 of the lower adapter 210, the spring 30 pushes against further movement of the body lock ring assembly and the mandrel 20 away from the upper adapter 160. As the pressure is increased, the body lock ring assembly pushes against the spring lock 90 compressing the spring 30. The pressure is increased until the spring lock 90 and the body lock assembly cause the spring 30 to become completely compressed within the spring holder 70. As discussed above, the movement of the body lock ring assembly also causes the movement of the mandrel 20 away from the upper adapter 160 because the interior teeth 12 of the body lock ring 10 are engaged with the exterior teeth 22 of the mandrel 20. During the initial cycle the mandrel 20 moves an initial distance until the spring holder 70 contacts the shoulder 211 of the lower adapter 210 plus the mandrel 20 moves an incremental distance that the body lock ring assembly travels while compressing the spring 30 within the spring holder 70. In one embodiment, the mandrel 20 may travel between 5 and 6 inches due during the initial pressure cycle. The length of the chamber and dimensions of the spring holder 70, and lock ring assembly may be adapted to modify the initial movement of the mandrel 20 as would be appreciated by one of ordinary skill in the art having the benefit of this disclosure. In subsequent cycles, the mandrel 20 only travels the incremental distance required to compress the spring 30 within the spring holder 70. In some embodiments, this incremental distance may be ¼ inch, however this distance may also be modified by varying the dimensions of the spring 30 and spring holder 70 as well as the strength of the spring 30.

After the spring 30 has been completely compressed, the pressure may then be bled off the system allowing the spring 30 to return to its uncompressed state pushing the spring lock 90 and the body lock ring assembly away in the opposite direction. Friction holds the mandrel 20 in place as the body lock ring assembly moves in the opposite direction. In some embodiments, a separate mechanism may be employed to hold the mandrel in position as the body lock ring assembly and spring lock 90 moves away from the compressed spring 30. The interior teeth 12 of the body lock ring 10 are adapted to allow movement along the mandrel 20 in the opposite direction as discussed in more detail below in regards to FIGS. 5 and 6. As will be recognized by one of ordinary skill in the art having the benefit of this disclosure, the spring constant of the spring 30 must be greater than the force required to allow the mechanism to ratchet along the mandrel 20. Additionally, the body lock assembly must be sufficiently strong to withstand the amount of pressure required to overcome the spring constant in order to ratchet the mechanism and move the mandrel 20 away from the upper adapter 160. The application of pressure to the system allows the mechanism to again move the body lock ring assembly and the mandrel 20 down an incremental distance until the spring 30 has been fully compressed within the spring holder 70. As discussed above, the dimensions of the spring 30 provides for the incremental distance moved by the mandrel 20 during each subsequent pressure cycle. After the initial cycle, the travel of the mandrel 20 and body lock ring assembly are limited to the distance required to completely compress the spring 30.

The pressure can be repeatedly cycled to incrementally move the mandrel 20 down the assembly until the mandrel has reached a final position. The mandrel 20 may include a stop 21 (Shown in FIGS. 7-11) that contacts the piston 40 when the mandrel 20 has been moved the designated distance. The stop 21 prevents further cycling of the step ratchet mechanism.

Back pressure may be applied to the system causing the piston 40 to move away from the lower adapter 210 and return to its initial position. The piston 40 may engage the ratchet lock ring 150 pulling the mandrel 20 back to its initial position. Alternatively, the mandrel 20 could include an upset that the piston 40 could engage pulling the mandrel back to its position as would be appreciated by one of ordinary skill in the art having the benefit of this disclosure. Likewise, the mandrel 20 may engage the body lock ring assembly pulling the assembly away from the lower adapter 210 and back to its original position. Alternatively, the application of back pressure may be used to move the body lock ring assembly and the spring holder 70 away from the lower adapter 210 to their original positions. A body lock ring holder 110 is used to anchor the body lock ring 10 to the top connector 130 when the mandrel 20 is moved back to its original position. The body lock ring holder 110 includes a vertical pin 120 positioned within the body lock ring carrier 15. The body lock ring holder 110 also includes axial pins 100 positioned through openings 13 (shown in FIG. 5) in the body lock ring 10. The axial pins 100 prevent the rotation of the body lock ring carrier 15 relative to the body lock ring 10.

Figure 2:
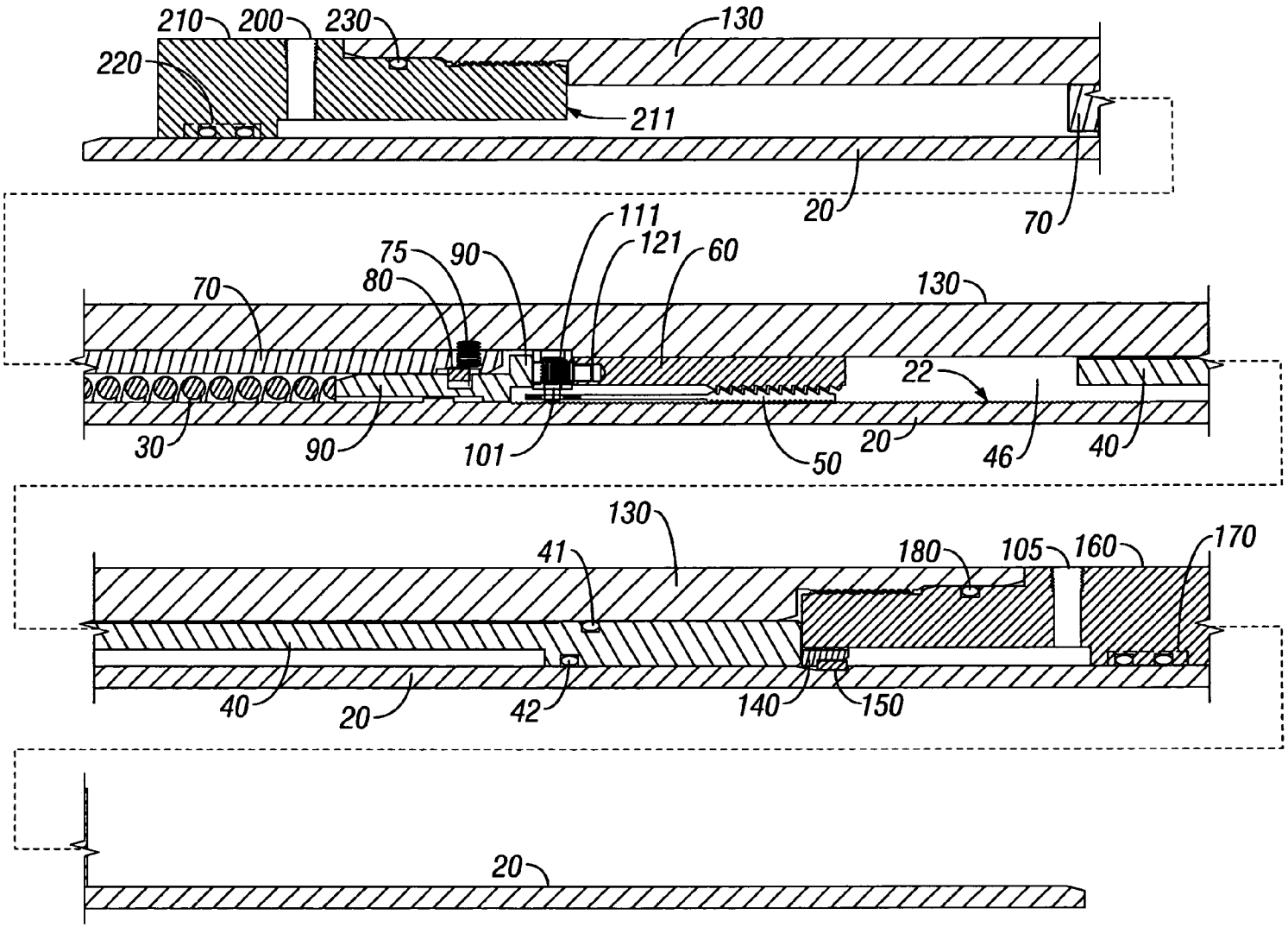
FIG. 2 is a cross-section view of one embodiment of a step ratchet mechanism that includes a body lock collet 50.

FIG. 2 shows an embodiment of the present disclosure that uses a body lock collet 50 and collet carrier 60 in place of the body lock ring 10 and body lock ring carrier 15 of the embodiment of FIG. 1. The mechanism operates in the same manner as the embodiment of FIG. 1. Pressure is applied to the system and the piston 40 pushes the body collet assembly down the top connector 130 away from the upper adapter 160. The pressure causes the interior teeth 52 of the body lock collet 50 to engage the teeth 22 on the exterior of the mandrel 20 thus, also moving it along the top connector 130 away from the upper adapter 160. When the spring holder 70 contacts the lower adapter 210 the pressure is increased until the collet assembly and the spring lock 90 completely compress the spring 30 located within the spring holder 170. The length of the collet fingers 54 allows for greater variation in the spring constant of the spring 30 used in the step ratchet mechanism.

Back pressure may also be applied to the system of FIG. 2 by applying pressure through the fluid port 200 in the lower adapter 210 causing the piston 40 to move away from the lower adapter 210 and return to its initial position. The piston 40 may engage the ratchet lock ring 150 on the mandrel 20 pulling the mandrel 20 back to its initial position. Alternatively, the mandrel 20 could include an upset that the piston 40 could engage pulling the mandrel back to its position as would be appreciated by one of ordinary skill in the art having the benefit of this disclosure. Likewise, the mandrel 20 may engage the body lock collet assembly pulling the assembly away from the lower adapter 210 and back to its original position. Alternatively, the application of back pressure may be used to move the body lock collet assembly and the spring holder 70 away from the lower adapter 210 to their original positions. A body lock collet holder 111 is used to anchor the body lock collet 50 to the top connector 130 when the mandrel 20 is moved back to its original position. The body lock collet holder 111 includes a vertical pin 121 positioned within the body lock collet carrier 60. The body lock collet holder 111 also includes axial pins 101 positioned through openings 53 (shown in FIG. 3) in the body lock collet 50. The axial pins 101 prevent the rotation of the body lock collet carrier 60 relative to the body lock collet 50.

Figure 4:
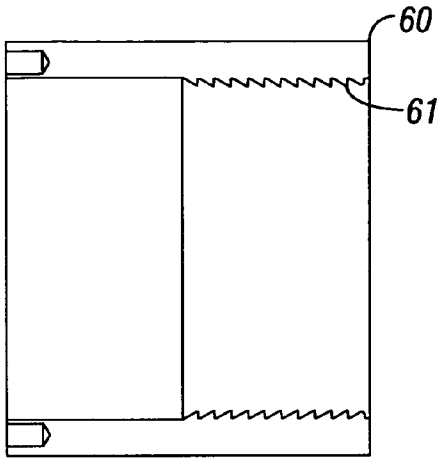
FIG. 4 is a side cross-section view of a collet carrier 60 used in conjunction with the body lock collet 50 of FIG. 3.
Figure 3:
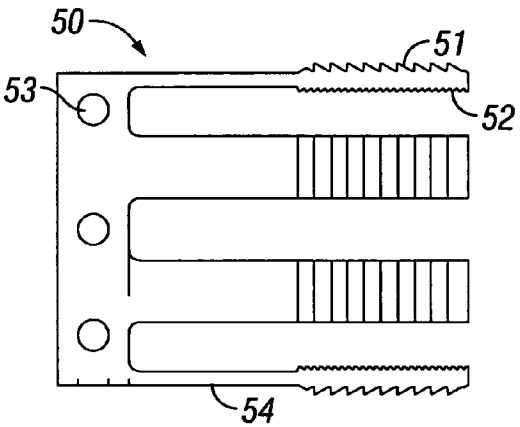
FIG. 3 is a side view of a body lock collet 50 used in one embodiment of a step ratchet mechanism.

FIG. 3 is an isometric view of a body lock collet 50 of one embodiment of the present disclosure. The body lock collet 50 includes collet finger 54 located around the perimeter of the collet. The number and width of the collet fingers 54 may be varied depending on application using a step ratchet mechanism as would be appreciated by one of ordinary skill in the art having the benefit of this disclosure. The interior surface of each collet finger 54 includes teeth 52 that are adapted to selectively engage the outer teeth 22 of the mandrel 20. The exterior surface of the each collet finger 54 includes teeth 51 adapted to engage with the interior teeth 61 of the body lock collet carrier 60. FIG. 4 shows one embodiment of a body lock collet carrier 60 of the present disclosure. The body lock collet carrier 60 includes teeth 61 on the interior surface, the teeth 61 being adapted to engage with the teeth 51 located on the collet fingers 54. The body lock collet 50 may include openings 53 located around the perimeter to aid in the connecting the body lock collet 50 to the body lock collet holder 110. For example, pins 101 may protrude from the body lock collet holder 110 through the openings 53 in the body lock collet 50.

Figure 5:
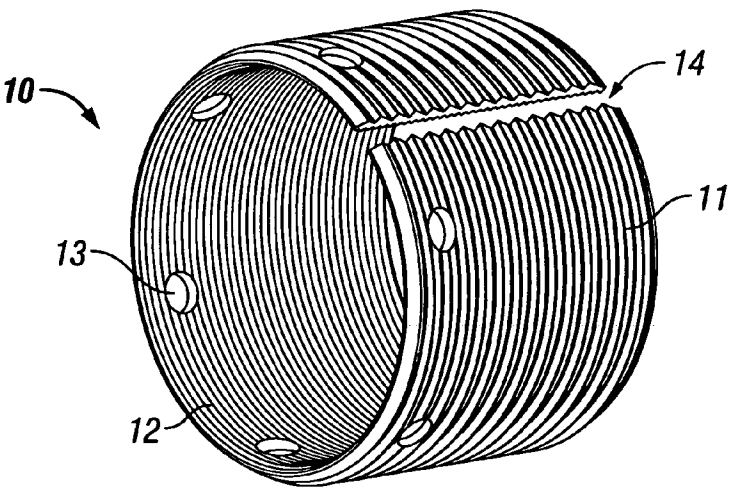
FIG. 5 is an isometric view of a body lock ring 10 used in one embodiment of a step ratchet mechanism.

FIG. 5 is an isometric view of a body lock ring 10 of one embodiment of the present disclosure. The interior surface of the body lock ring 10 includes teeth 12 that are adapted to selectively engage the outer teeth 22 of the mandrel 20. The body lock ring 10 may include a gap 14 in the body. The gap 14 may aid in the selective engagement of teeth 12 with the teeth 22 of the mandrel 20. The exterior surface of the body lock ring 10 includes teeth 11 adapted to engage with the interior teeth of the body lock ring carrier 15. The body lock ring 10 may include openings 13 located around the perimeter to aid in the connecting the body lock ring 10 to the body lock ring holder 110. For example, pins 100 may protrude from the body lock ring holder 110 through the openings 13 in the body lock ring 10.

Figure 6:
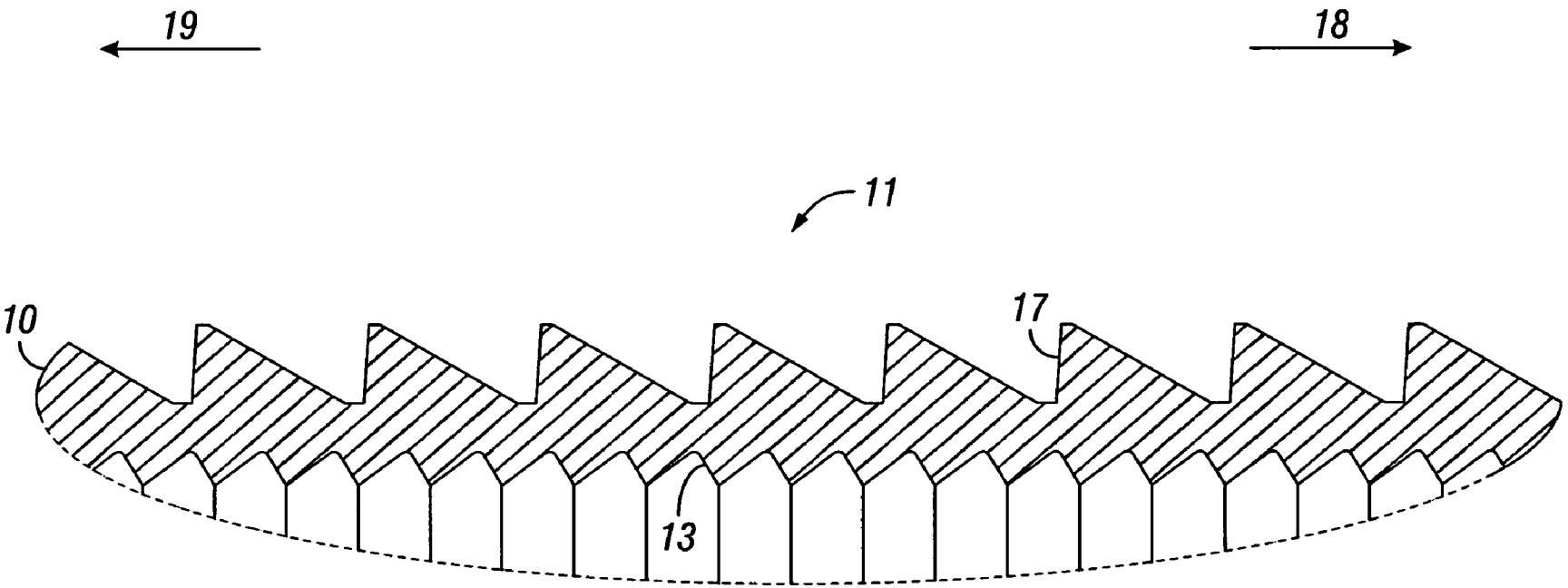
FIG. 6 is a cross-section view of one embodiment of the engaging teeth of the body lock ring 10 with outer teeth 11 that engage the body lock ring carrier 15 and inner teeth 12 that engage the mandrel 20.

FIG. 6 is a cross-sectional view of the teeth of the body lock ring 10. The exterior surface of the body lock ring 10 includes teeth 11 that are configured to engage with the interior teeth of the body lock ring carrier 15. The interior surface of the body lock ring 10 includes teeth 12 that are adapted to selectively engage the teeth 22 located on the exterior surface of the mandrel 20. A 90 degree face 17 on the outer teeth 11 in combination with an angle substantially less than 90 degrees on the inner teeth allows the body lock ring carrier 15 to ratchet the body lock ring 10 along the mandrel 20 in a direction 18 away from the lower adapter (not shown in FIG. 6). An angle substantially less than 90 degrees on the outer teeth, in combination with an angle of 90 degrees on the inner teeth prevents the body lock ring carrier 15 from moving the body lock ring 10 along the mandrel in the opposite direction 19. Conventional body lock rings generally have a 90 degree face on both the inner and outer teeth. The 90 degree angles may actually be only 85 degrees on conventional body lock rings to allow the body lock ring to be manufactured more easily. Both the conventional body lock rings and the body lock ring 10 of the present disclosure will ratchet along the mandrel 20 in one direction 19 and will lock to the mandrel 20 when pushed in the other direction 18. However, conventional body lock rings will not allow the reverse motion of the mandrel 20 to return the mandrel 20 to its original position when the body lock ring 10 is anchored.

The teeth 12 on the interior surface of the body lock ring 10 of FIG. 6 have been modified to allow the mandrel 20 to be moved to its original position. Specifically, the angle of face 13 of the inner teeth 12 has been swept back such that the body lock ring 10 may ratchet in the direction 19 along the mandrel 20 as it is moved back. This occurs when pressure is applied to the lower side of the piston 40 (not shown in FIG. 6) and the piston 40 pulls the mandrel 20 upwards to its original position. The body lock ring 10 ratchets along the mandrel 20 as the body lock ring 10 is anchored to the top connector 130 by the body lock ring holder 110 and the radial pins 100. The actual angle at which the face 13 of the inner teeth 12 is swept back may be modified with differing degrees depending on the application as would be recognized by one of ordinary skill in the art having the benefit of this disclosure.

Figure 13:
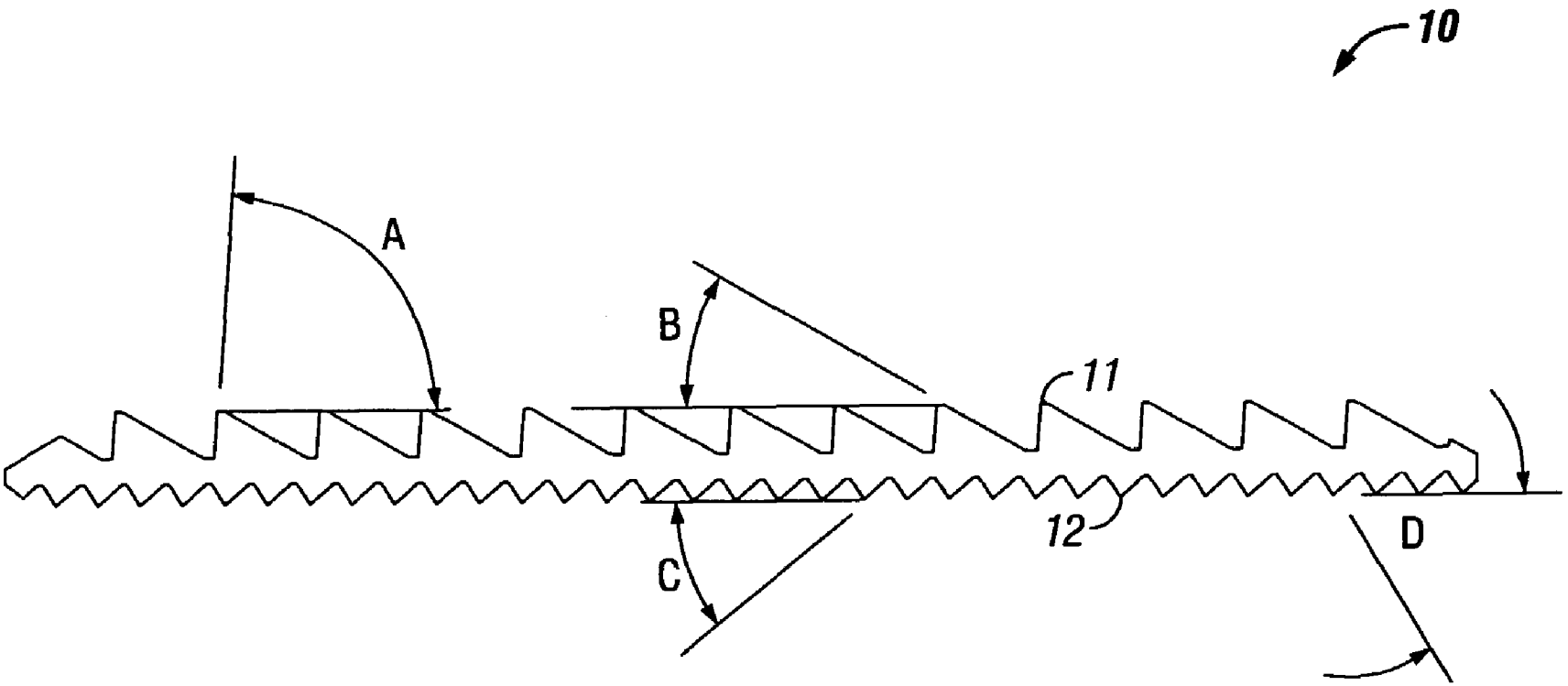
FIG. 13 is a cross-section of one embodiment of the body lock ring 10 of the present disclosure.

FIG. 13 illustrates one embodiment of the body lock ring 10 of the present disclosure and the modification to the inner teeth 12 of the body lock ring to function like a convention body lock ring and also to allow the body lock ring 10 to ratchet along a mandrel when the mandrel is moved upwards to its original position. Angle A of the outer teeth 11 would preferably be 90 degrees to engage the teeth of the body lock ring carrier 15 (not shown). However, angle A may range between 80 to 95 degrees and still sufficiently provide a face to engage with the teeth of the body lock ring carrier as would be appreciated by one of ordinary skill in the art having the benefit of this disclosure.

Angle D of the inner teeth 12 must be small enough to allow the body lock ring to ratchet along the mandrel. The maximum that Angle D may be is approximately 70 degrees. Angle B of the outer teeth 11 should be at least 20 degrees less than angle D of the inner teeth 12 to allow the body lock ring 10 to clamp to the mandrel. The maximum angle for Angle C of the inner teeth 12 is approximately 70 degrees. Angle C must be small enough to allow the body lock ring to ratchet along the mandrel and angle C should be at least 20 degrees less than angle A of the outer teeth 11.

Figure 7:
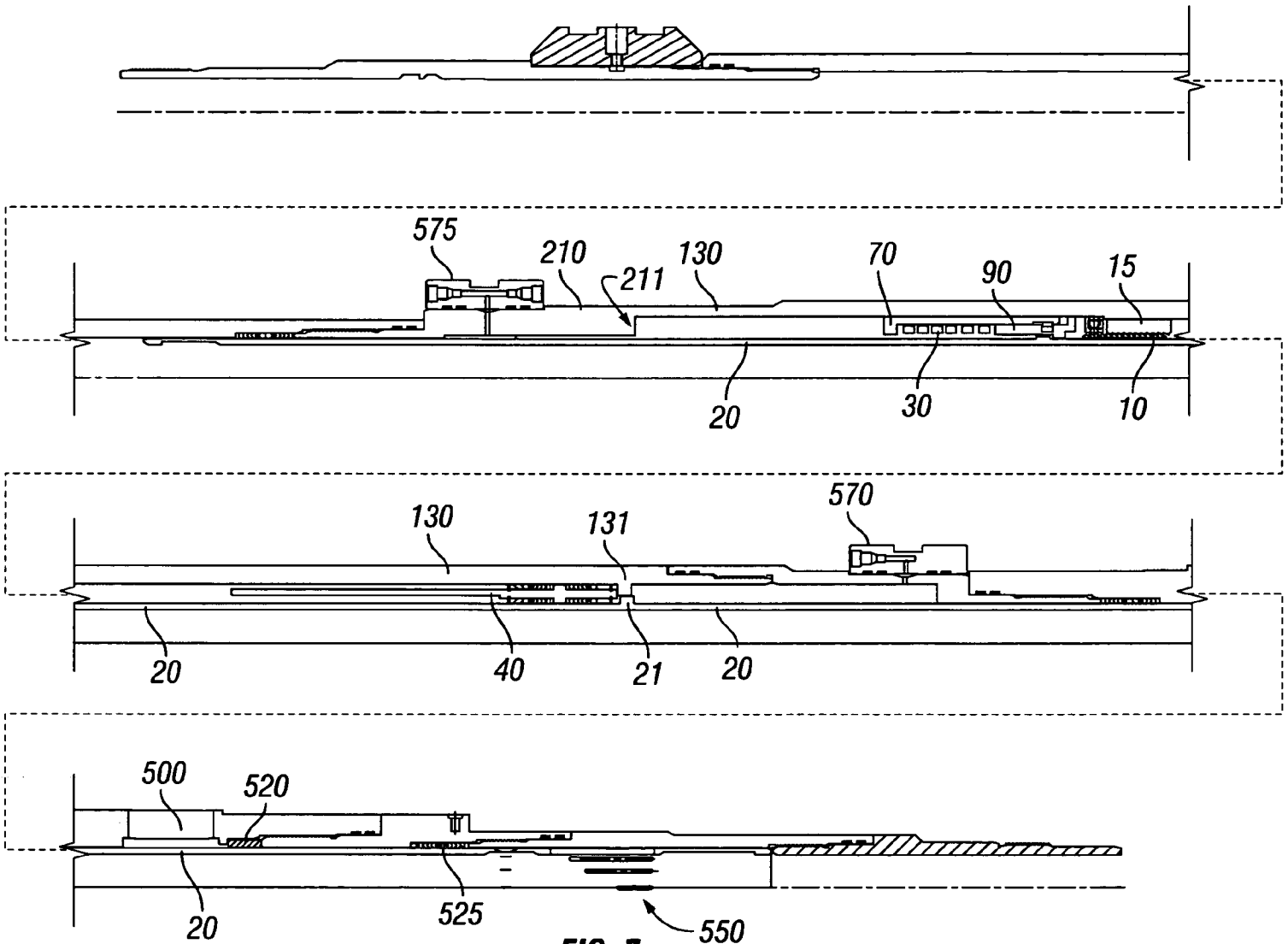
FIG. 7 is a cross-section of one embodiment of the step ratchet mechanism in its initial position.

FIG. 7 is a cross-section view of the step ratchet mechanism used in conjunction with adjustable orifices. FIG. 7 depicts the mechanism in the initial state. In the initial state the piston 40 is located against stop 131 of the top connector. The orifices 550 are located to the right of seals 525 and thus, no fluid is flowing through the fluid port 500. As discussed above, pressure is applied to the system and the piston 40 moves away from the fluid port 500 until it contacts the body lock ring carrier 15. The pressure causes the body lock ring to engage the mandrel 20 and the movement of the piston also causes the movement of the mandrel away from the fluid port 500. By way of example, pressure may be applied to the system via hydraulic connector 570 which is in fluid communication with piston 40. A hydraulic line (not shown) is connected to connector 570 and extends to the surface. Pressure is applied through connector 570 to move piston 40 to open the valve mechanism. The embodiment shown in FIG. 7 includes a restrictor ring 520. The restrictor ring 520 may be comprised of erosion resistant material that allows minimal flow past it to the fluid port 500.

Figure 8:
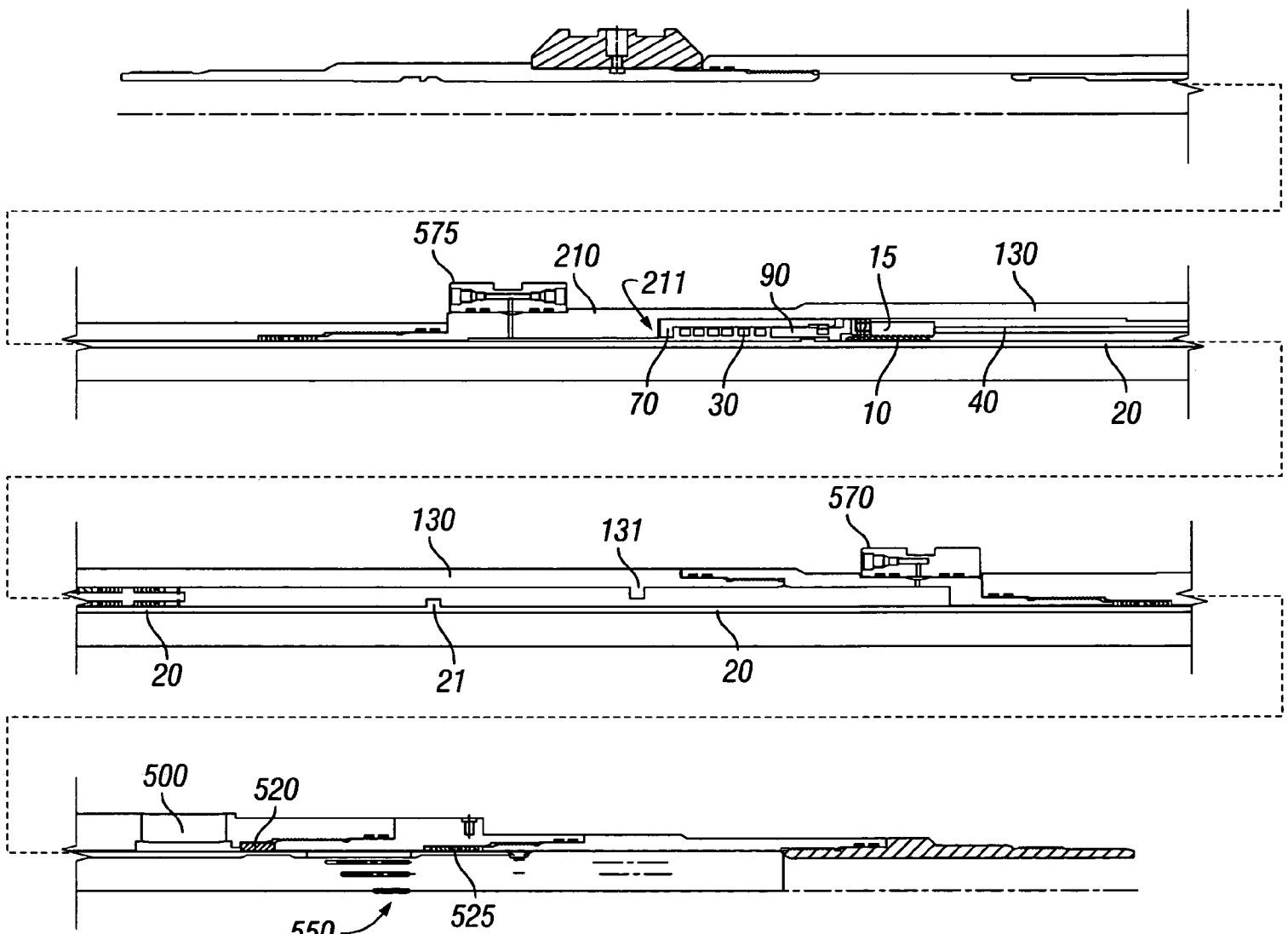
FIG. 8 is a cross-section of the step ratchet mechanism of FIG. 7 after the pressure cycle has been applied once to the system.

FIG. 8 illustrates that embodiment of FIG. 7 after the first pressure cycle has been applied to the system. The piston 40 has engaged the body lock ring carrier 15 moving the body lock ring carrier 15, the body lock ring 10, the mandrel 20, the spring lock 90 and the spring holder 70 away from the fluid port 500. The spring holder 70 has contacted shoulder 211, thus further movement of the mandrel 20 will be limited to the incremental distance required for the spring lock 90 to compress the spring 30 within the spring holder 70. After the first pressure cycle, the orifices 550 have move completely past the seals 525 and thus, the seals 525 are protected from damage. The restrictor ring 520 will still limit minimal flow to the fluid port 500 when the orifices 550 are in this position.

Figure 9:
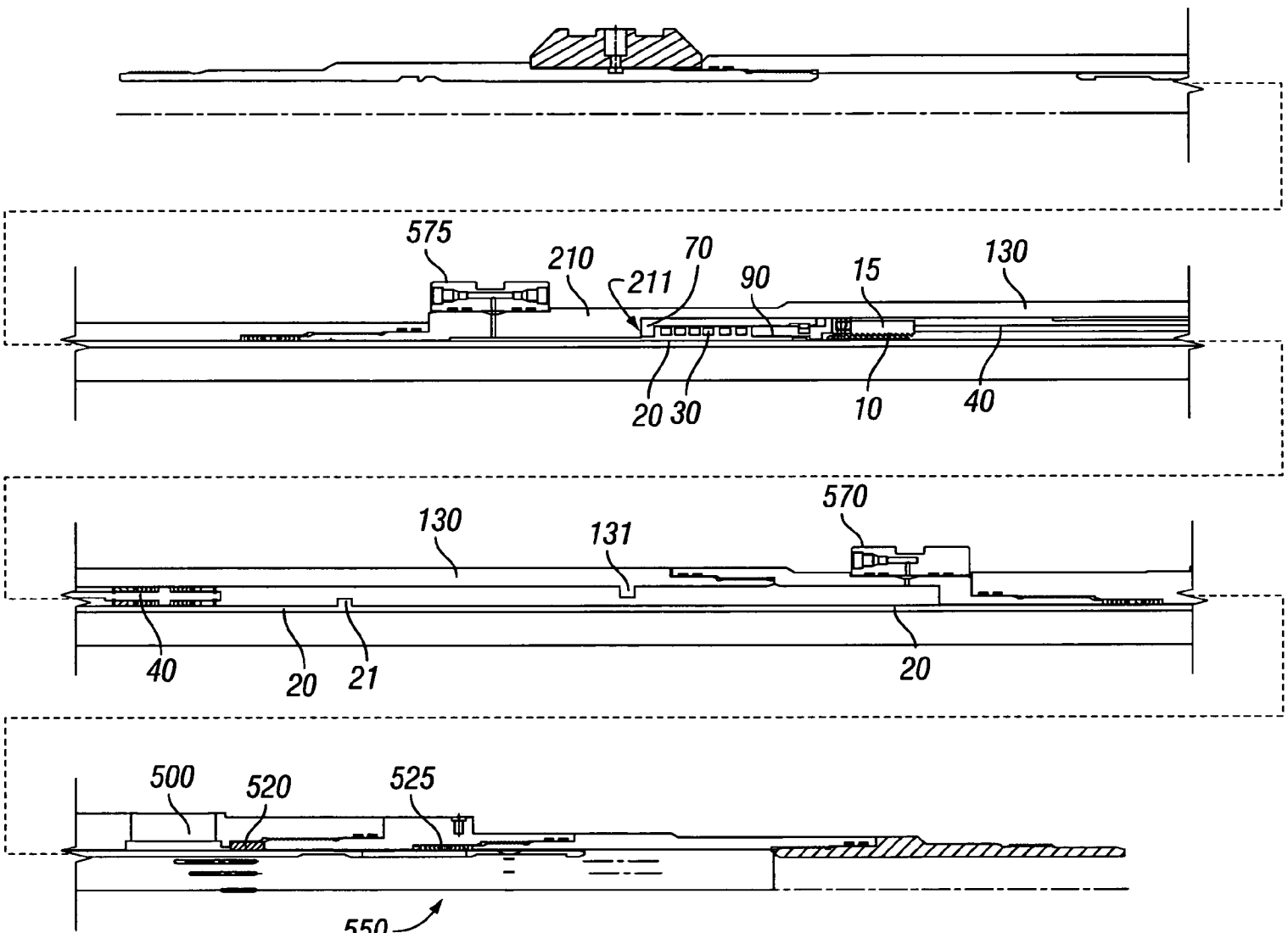
FIG. 9 is a cross-section of the step ratchet mechanism of FIG. 7 that has been cycled a number of times such that the flow orifices are in a position they may remain during production through the fluid port 500.

FIG. 9 illustrates the position of the adjustable orifices 550 partially past the restrictor ring 520 after a number of pressure cycles have been applied to the system. This may be the position the system would be left in during production through the fluid port 500. As the downhole reservoir is depleted, one or two pressure cycles may be applied to the system to move the orifices 550 farther past the restrictor ring 520 increasing the flow path through fluid port 500.

Figure 10:
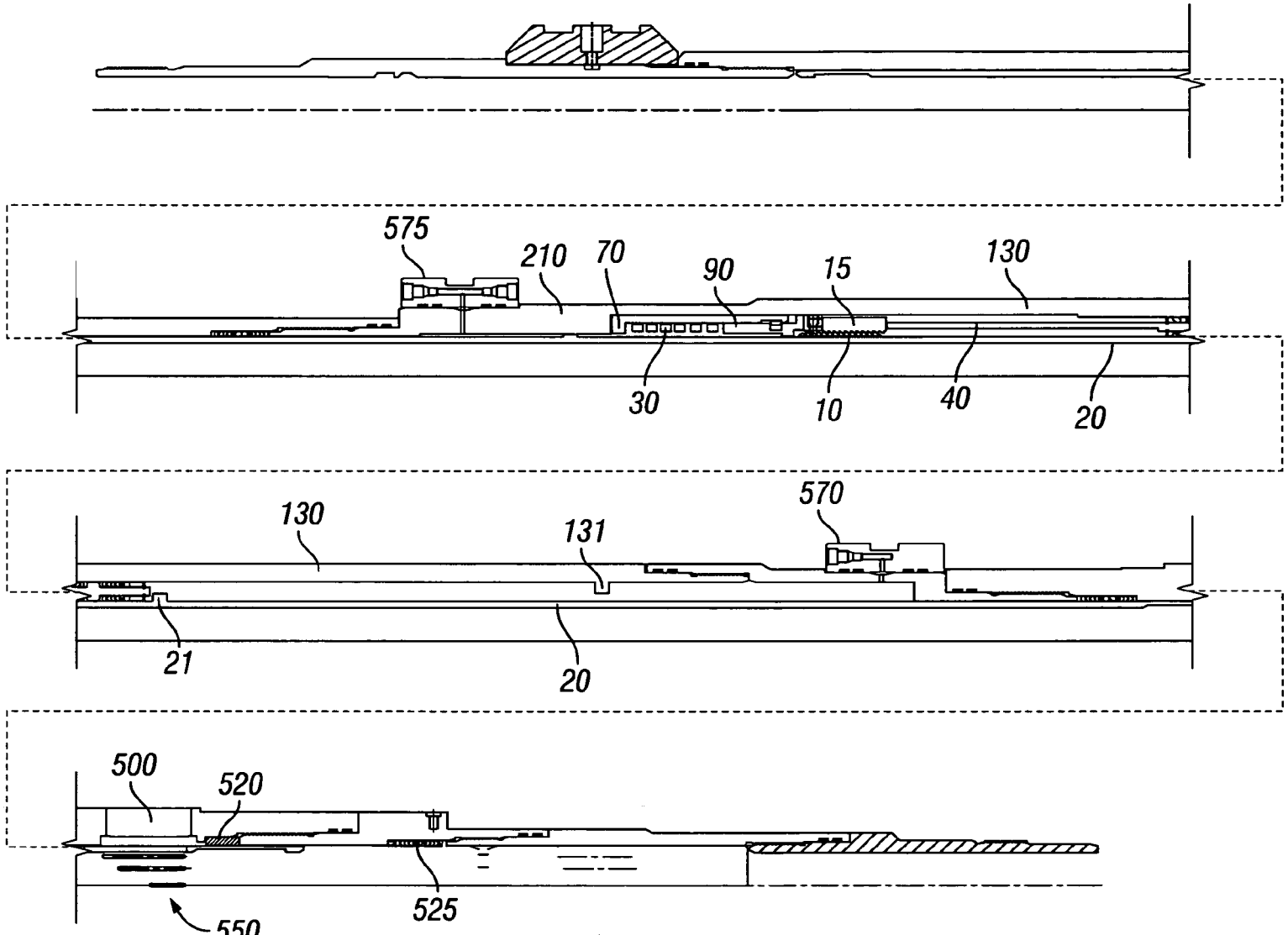
FIG. 10 is a cross-section of the step ratchet mechanism of FIG. 7 that has been repeatedly cycled until the mandrel has moved to its final position completely opening the flow orifices 550 in fluid communication with fluid passage 500.
Figure 11:
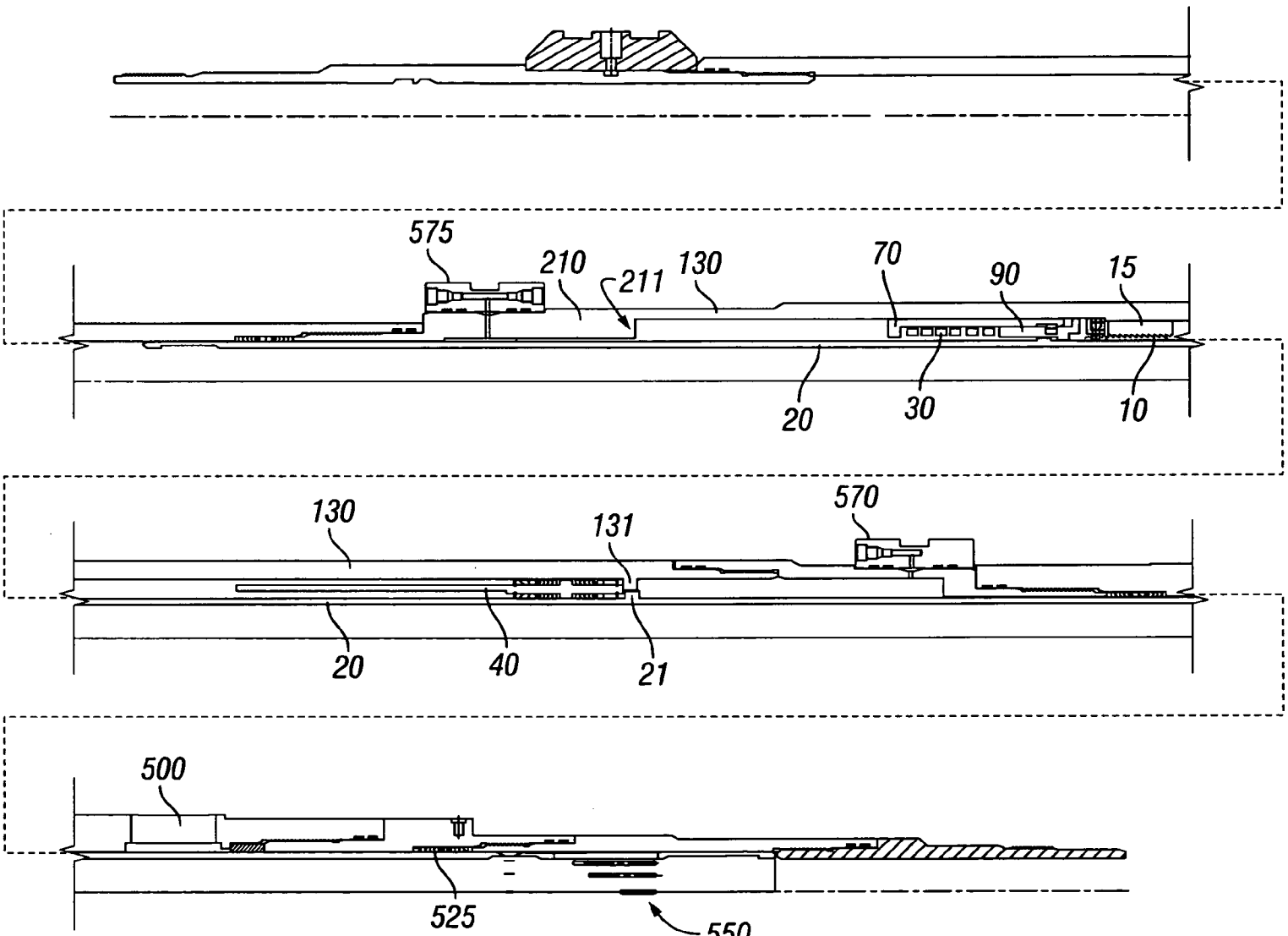
FIG. 11 is a cross-section of the step ratchet mechanism of FIG. 7 that has been returned to the initial position, thus closing the flow orifices 550.

FIG. 10 illustrates the adjustable orifices 550 fully open and the step mechanism completely cycled. The adjustable orifices 550 are completely aligned with the fluid port 500 allowing maximum fluid flow. The piston 40 engages the body lock ring carrier 15 and further cycles are prevented by the mandrel stop 21 contacting the upper portion of the piston 40. FIG. 11 illustrates the adjustable orifices 550 located in the fully closed position located to the right of the seals 525. The seals 525 prevent any fluid flow between the orifices 550 and the fluid port 500. The adjustable orifices are returned to the closed position when the mandrel is returned to the initial position as indicated by the alignment of the mandrel stop 21 with the top connector stop 131. Back pressure is applied to the system moving the mandrel 20, body lock ring assembly, spring holder 70, and the piston 40 to their original positions. Closing pressure is applied through a closing line (not shown) that extends from the surface to hydraulic connector 575. Hydraulic connector 575 is in fluid communication with the opposite side of piston 40. Connector 575 provides an additional outlet for connecting the closing line (not shown) to additional valve assemblies should it be desirable to run a plurality of assemblies in series.

The adjustable orifices and fluid port of the embodiments of FIGS. 7-11 are shown for illustrations purposes and are but one embodiment of the present disclosure. The actual configuration of an adjustable orifices used in conjunction with the step ratchet mechanism may be varied as would be appreciated by one of ordinary skill in the art. Further, the step ratchet mechanism is applicable to drive a varying number of downhole multi-position devices as would be appreciated by one of ordinary skill in the art.

Figure 12:
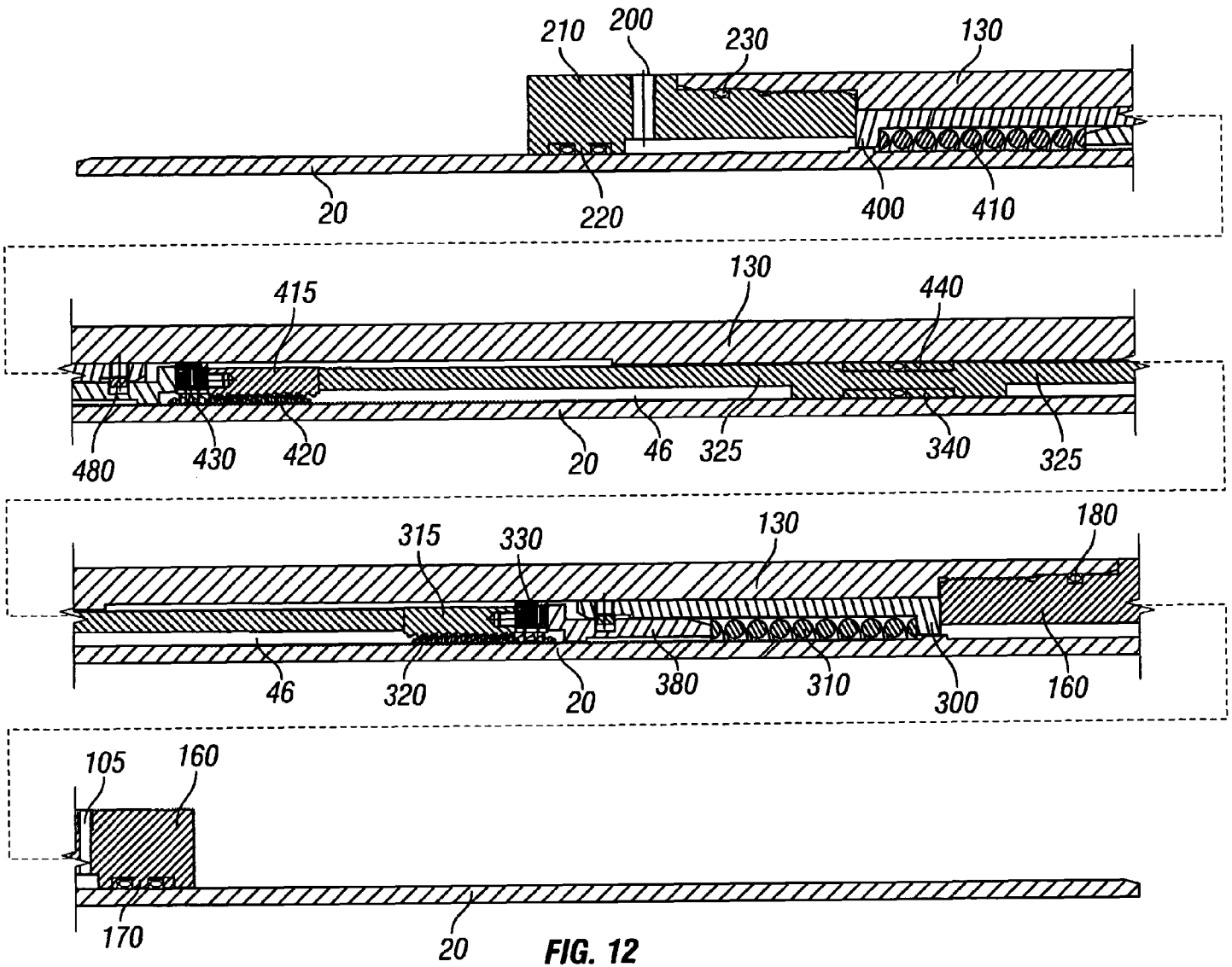
FIG. 12 is an embodiment of the step ratchet mechanism that provides for ratcheting movement in both directions.

FIG. 12 shows one embodiment of the present disclosure that provides for ratcheting movement in both directions along a mandrel 20. An upper step ratchet mechanism comprising a spring holder 300, a spring 310, a spring lock 380, a body lock ring holder 330, a body lock ring carrier 315, and a body lock ring 320 may be connected to one end of a piston 325. A lower step ratchet mechanism comprising a spring holder 400, a spring 410, a spring lock 480, a body lock ring holder 430, a body lock ring carrier 415, and a body lock ring 420 may be connected to the other end of the piston 325. The components may be connected and configured as the other embodiments as discussed above.

The piston 325 and the upper and lower step ratchet mechanism travel along a chamber located between a top connector 130 and a mandrel 20. The upper and lower step ratchet mechanisms may be positioned adjacent an upper adapter 160 and a lower adapter 210 respectively. Pressure may be introduced into the chamber via ports 200 or 105. The pressure causes the mandrel to move. The presence of the upper and lower step ratchet mechanisms causes the location of the mandrel to ratchet in either direction. The body lock rings 320, 420 engage the teeth on the mandrel 20 as discussed above. This configuration allows for the incremental movement of the system in either direction if needed.

Figure 14:
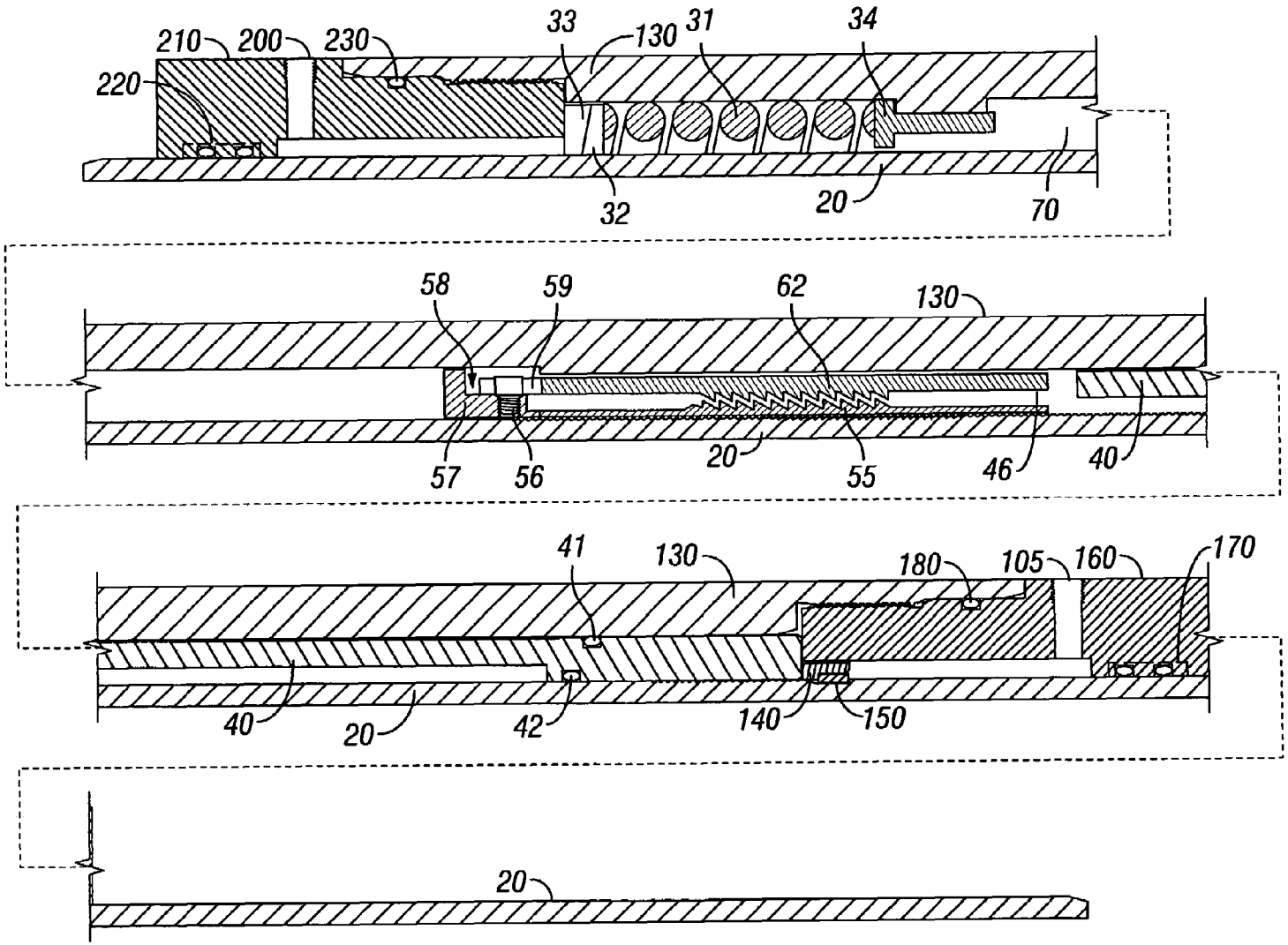
FIG. 14 is a cross-section view of one embodiment of a step ratchet mechanism that includes a double ended body lock collet 55.
Figure 15A:
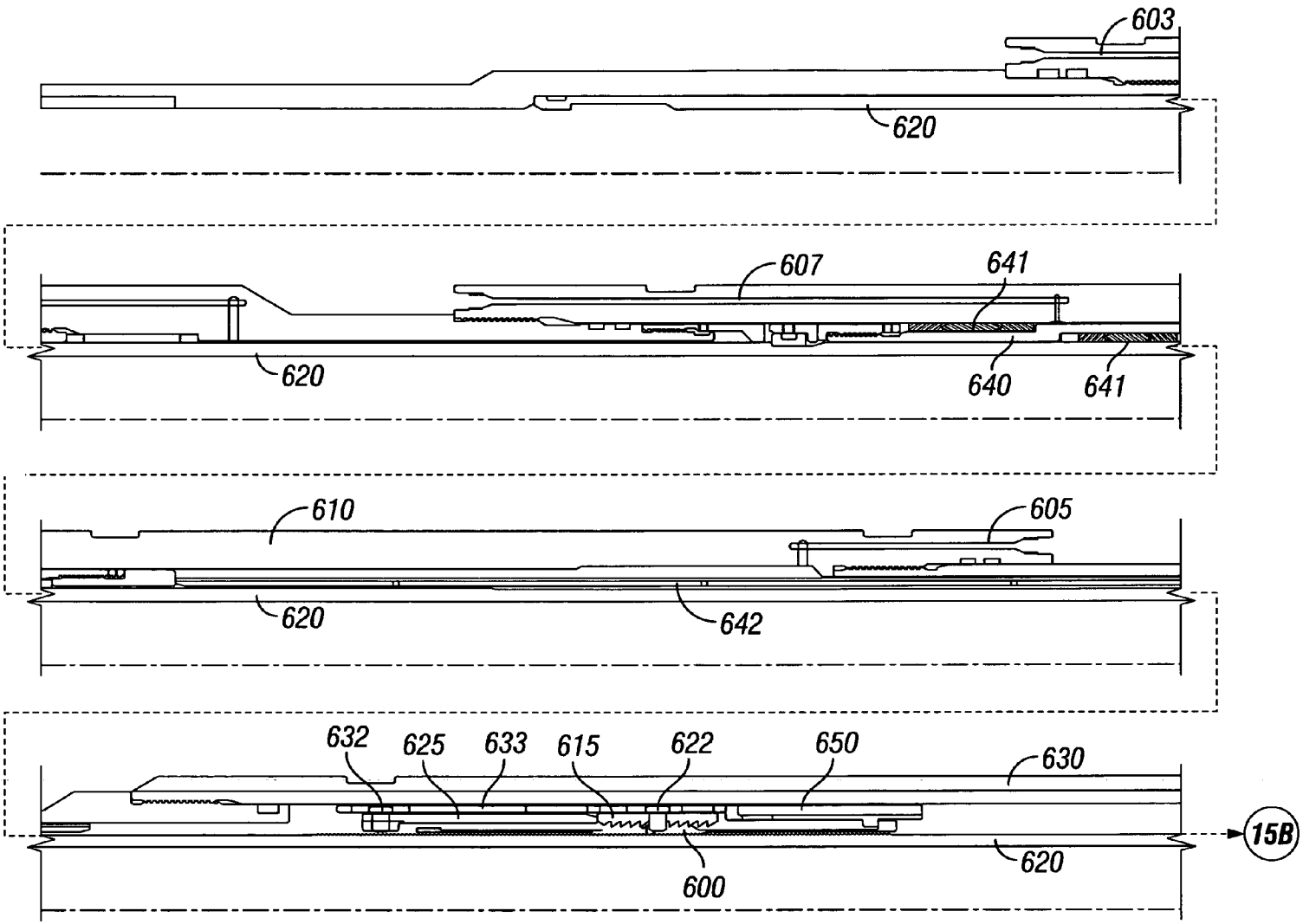
FIGS. 15A and 15B are a cross-section of another embodiment of the step ratchet mechanism in its initial position
Figure 15B:
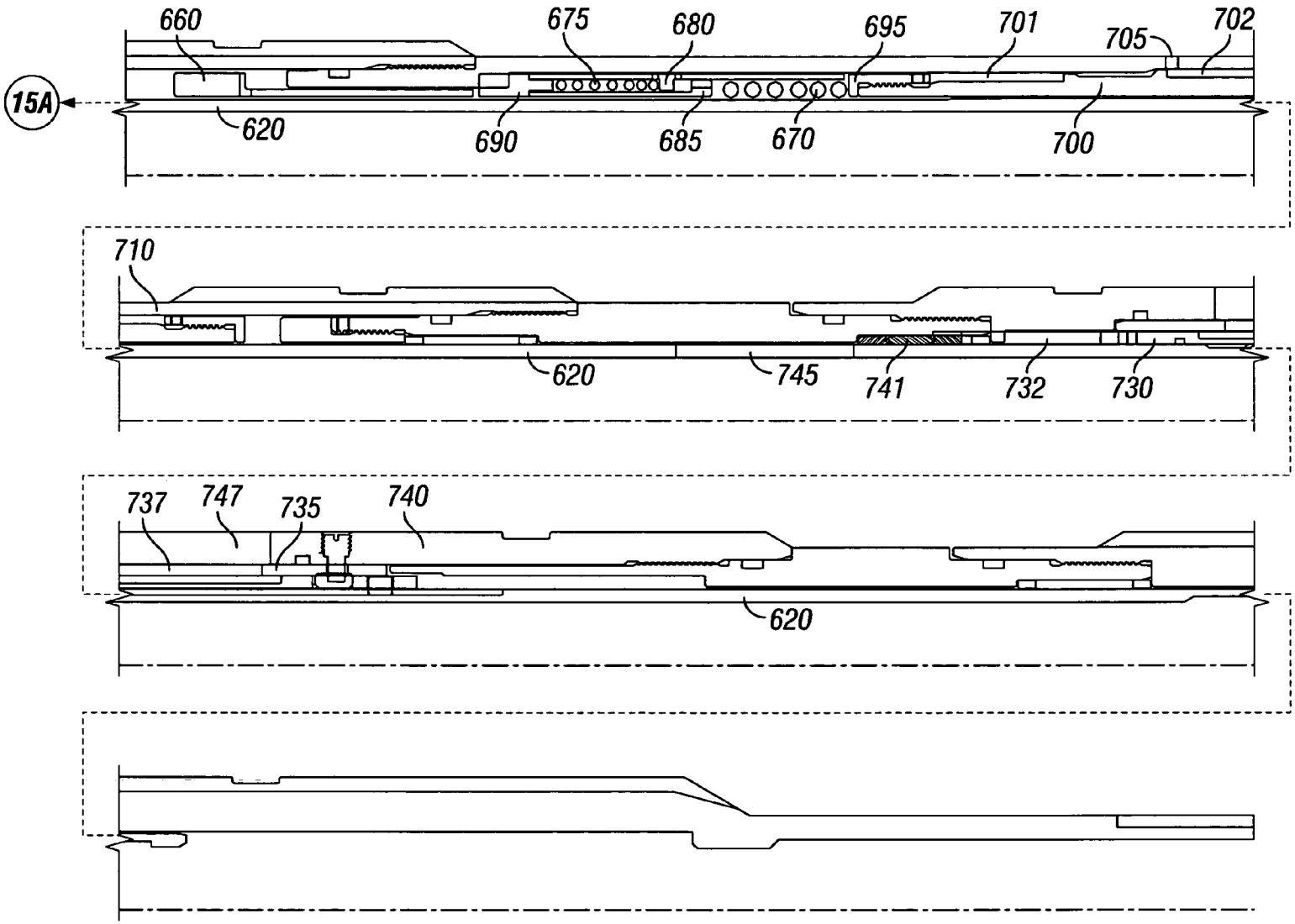

FIG. 14 shows an embodiment of the present disclosure that uses a double ended body lock collet 55 and a collet carrier 62 in place of the body lock collet 50 shown in FIG. 2. The mechanism operates in a similar manner as the embodiment of FIG. 2. Pressure is applied to the system and the piston 40 moves within a chamber of the step ratchet mechanism pushing the doubled ended body lock collet assembly down the top connector 130 away from the upper adapter 160. The pressure causes the interior teeth of the body lock collet 55 to engage teeth on the exterior of the mandrel 20 thus, also moving it along the top connector 130 away from the upper adapter 160. The double ended body lock collet assembly will continue to move along the top connector 130 until it contacts a cylinder 34. The cylinder 34 is positioned adjacent to one end of a spring 31 that is located within the chamber of the step ratchet mechanism. When the double ended body lock collet assembly contacts the cylinder 34, the pressure is increased until the cylinder 34 completely compress the spring 31 located within the chamber. The use of the spring 31 positioned within the chamber and not within a spring housing, as shown in FIG. 2, provides for more variation in the incremental distance moved during each pressure cycle and allows the use of a stronger spring.

The lower end of the double ended body lock collet 55 may include an upset 57 and a screw 56 in order to prevent rotation between the double ended body lock collet 55 and the body lock collet carrier 62. The screw 56 may be positioned within a slot 59 (or oversized hole) of the body lock collet carrier 62 as shown in FIG. 14. The length of the body lock collet carrier 62 may provide a gap 58 between the end of the body lock collet carrier 62 and the upset 57. The gap provides sufficient space for collet carrier 62 to move downward to engage the threads of body lock collet 55. The step mechanism may also include a friction ring 32 positioned adjacent to a second end of the spring 31 and a beveled ring 33 positioned adjacent to the friction ring 32. The friction ring 32 may be a split ring that is forced against the mandrel 20 by the beveled ring 33 as the spring 31 is compressed within the chamber of the mechanism. The friction ring helps increase friction to maintain the mandrel in a stationary position when the body lock ring is being pushed back up the mandrel.

FIGS. 15-18 illustrate another system that utilizes the step ratchet mechanism of the present invention in conjunction with adjustable orifices. FIGS. 15A and 15B illustrate the system in the initial position with the adjustable orifices in the closed position. FIGS. 16A and 16B illustrate the first stroke of the pressure cycle on the system. FIGS. 17A and 17B illustrate the final stroke of the system with the adjustable orifices in the fully opened position. FIGS. 18A and 18B illustrate the system after the power piston and mandrel have been reset, closing the orifices.

In this embodiment, the step ratchet mechanism includes a double ended collet 600, collet carrier 615, power piston 640, and mandrel 620. The lower portion of the mandrel includes one or more flow slots 745 that may be positioned relative to one or more radial flow ports 747 in an outer orifice housing to provide an adjustable flow orifice as more fully described below. Piston 640 is positioned in a chamber formed by mandrel 620 and piston housing 610. The piston is in fluid communication with opening port 603 that extends through piston housing 610. The opening port terminates at a hydraulic connector for connecting a hydraulic control line (not shown) which extends to the surface of the well. Piston 640 includes upper and lower seal stacks 641 which seal against the inner diameter of the piston housing and the outer diameter of the mandrel respectively. When pressure is applied through the opening port, piston 640 will move from the initial position shown in FIG. 15A to the position shown in FIG. 16A. Piston housing 610 includes a return or close port 605 which, like the opening port, terminates on one end at a hydraulic connector for a hydraulic control line (not shown). Surface pressure can be applied through the control line, through port 605 to move piston 640 back to its initial position, shown in FIG. 18A. Piston spacer 642 abuts one end of piston 640 and is slidably received within the piston chamber and moves with the piston.

Double ended collet 600 is a cylindrical shaped sleeve having a plurality of longitudinal slots in the sleeve so the center section of the collet (i.e., the collet fingers) can expand and contract. By way of example, the collet has eight longitudinal slots that are located equally about the cylindrical sleeve creating a number of flexible fingers with both ends of the fingers fixed. The collet includes an upset area proximate the middle of each flexible finger with threads on the internal surface for engaging mandrel 620 and larger, coarser threads on the external surface for engaging collet carrier 615. The ratchet assembly preferably includes one or more pins 622 that prevent rotation between the collet 600 and carrier 615 to maintain alignment of the mating threads. Anti-rotation pin 622 extends through a slot in ratchet housing 650. Pusher sleeve 625 is mounted to ratchet spacer 633 by pin 632. Ratchet spacer 633 and ratchet housing 650 collectively contain the pusher sleeve, the collet carrier and the double ended collet, the entire assembly being slidably received within top connector 630.

Figure 16A:
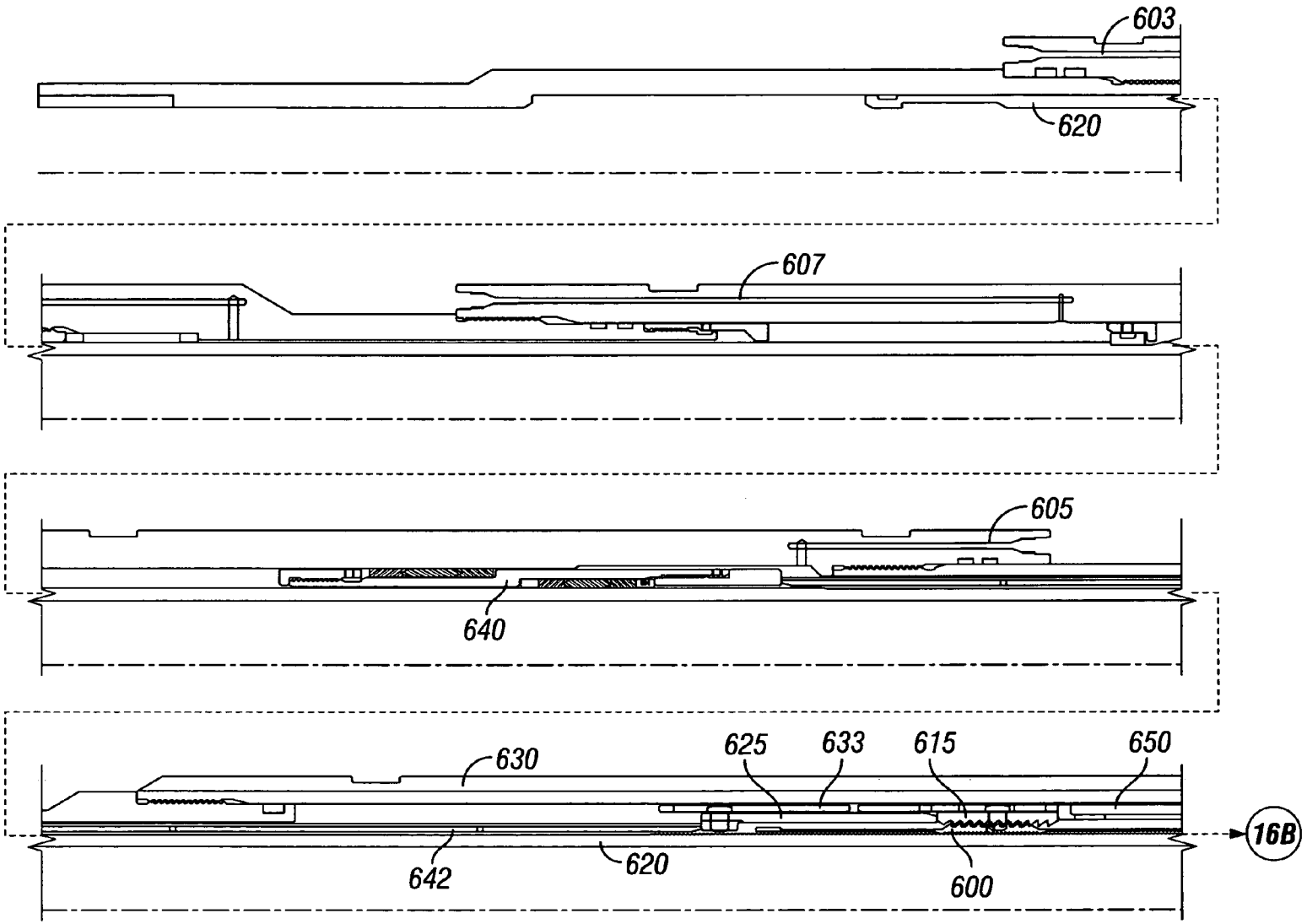
FIGS. 16A and 16B are a cross-section of the step ratchet mechanism of FIGS. 15A and 15B after the pressure cycle has been applied once to the system.

Pusher sleeve 625 abuts collet carrier 615 and pushes against the carrier when contacted by piston spacer 642, as shown in FIG. 16A. Piston spacer 642 contacts the pusher sleeve when pressure is applied to power piston 640, as described below. Collet carrier 615 in turn pushes against a shoulder of ratchet housing 650. The collet carrier rides on the shallow angle side of the outer threads of collet 600 and pushes the collet down, causing the collet to clamp onto the threads of mandrel 620. Thus, piston spacer 642 will apply a force to the collet carrier via the parts of the ratchet assembly causing the collet to clamp down on the mandrel wherein the entire assembly and mandrel may be moved down.

The ratchet mechanism of FIGS. 15-18 includes a double spring arrangement comprising primary spring 670 and secondary spring 675 which operate in parallel to provide more spring force. Secondary spring 675 is contained between the upper portion of outer spring sleeve 680 and the inner spring sleeve 685. Primary spring 670 is contained between the lower portion of the outer spring sleeve and mandrel 620. Sleeve connector 690 connects the inner spring sleeve to the outer spring sleeve. Spring pusher 660 extends from the double spring arrangement and, as shown in FIG. 16B, is used to compress the springs when contacted by ratchet housing 650. When contacted by the ratchet housing, spring pusher applies a force to connector 690, which in turn causes secondary spring 675 to compress against an inward shoulder radially extending from the outer spring sleeve. Simultaneously, the inner spring sleeve compresses primary spring 670 against stop 695. As with previous embodiments, the double spring arrangement will return the collet and collet carrier up relative to the mandrel when pressure is bled off piston 640 and the spring returns to its non-compressed state. Thus, by cycling the opening pressure on and off, the mandrel can be incrementally moved downward toward the flow orifice mechanism. The ability to incrementally move the mandrel in a controlled fashion allows for an adjustable flow orifice, as described.

The double spring arrangement abuts ratchet return piston 700. In the event that springs 670 and 675 fail, ratchet return piston can be hydraulically actuated to operate the valve. Piston 700 has two seal stacks 701 and 702 on its exterior surface to provide a piston area between the piston and the inner diameter of spring housing 710. A port 705 extends through the spring housing to provide communication between the annulus and the piston area. To operate ratchet return piston 700, pressure, for example 500 psi, is applied to the return port 605. A larger pressure is applied to the opening port to push the power piston to the position shown in FIG. 16A. To incrementally move the ratchet assembly up the mandrel via the return piston, the opening line pressure is bled to the same pressure (in this example 500 psi) in the return line. The return pressure is felt on return piston 700 and exceeds the annulus pressure applied through port 705. This pressure differential causes the return piston to move upwardly, pushing the ratchet assembly up relative to the mandrel. Under the conditions described, the ratchet return piston will act in substantially the same way as the double spring arrangement. One of skill will appreciate that the ratchet return piston may be used with other spring arrangements, such as the spring arrangements describe in the other embodiments of the invention. Increasing the pressure in the opening line again will cause the power piston to incrementally move the mandrel down. These steps can be repeated as desired until the systems orifice is fully opened as depicted in FIG. 17.

Figure 16B:
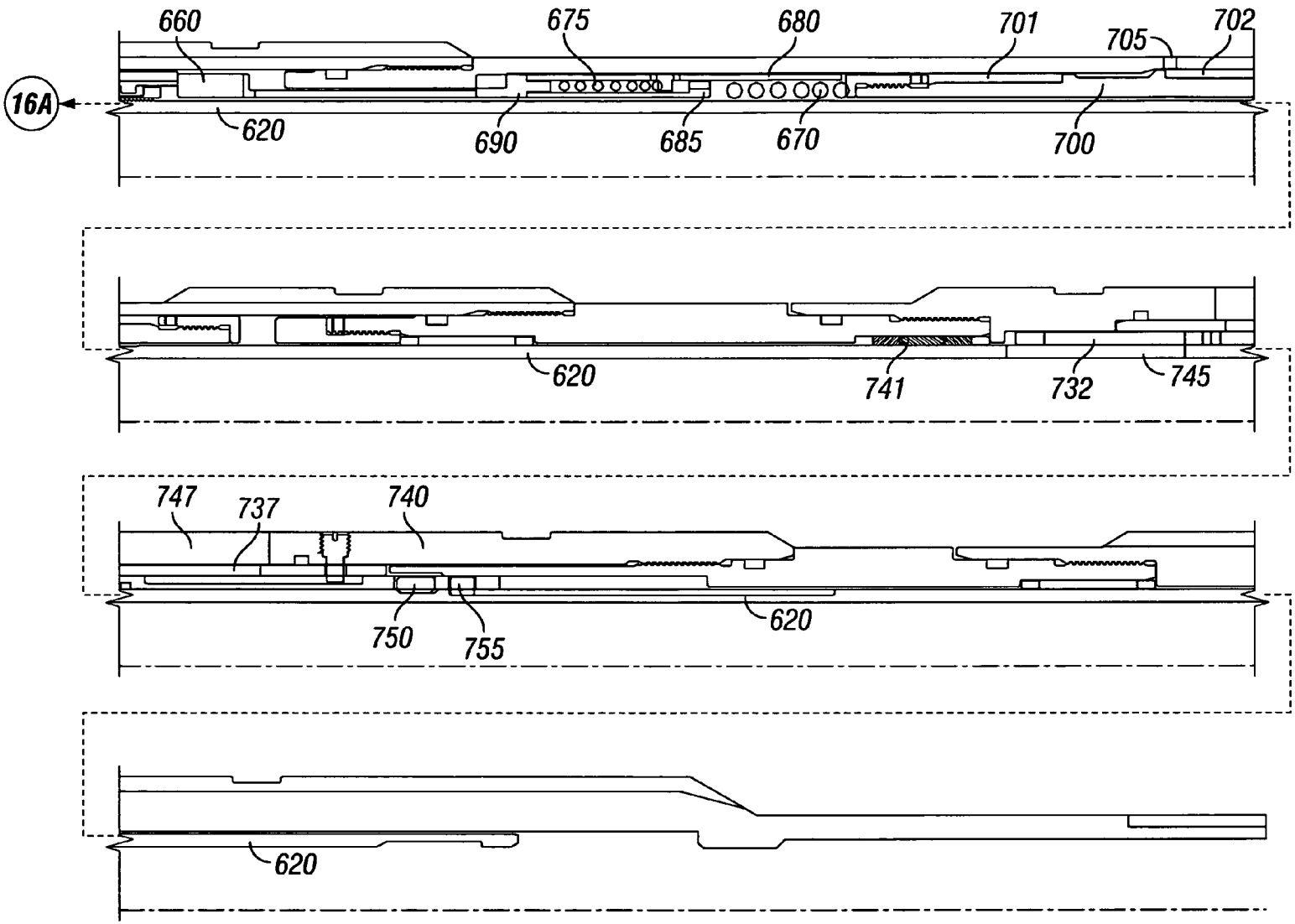

The adjustable flow orifice preferably includes outer orifice sleeve 735 and inner orifice sleeve 730, both sleeves made of wear resistant carbide or other hard material. The outer orifice sleeve 735 is fixed to outer housing 740 and includes flow slots 737 which are substantially aligned with flow ports 747 in outer housing 740. When the power piston is moved from its initial position to the position shown in FIG. 16A, mandrel 620 also moves downwardly allowing flow slots 745 in the mandrel to move past seal stack 741 sealing the upper end of the outer housing. Mandrel flow slots 745 substantially align with flow slots 732 in the inner orifice sleeve, as shown in FIG. 16B. Pins 752 extend from sleeve 730 into mating key slots in the mandrel. Pins 752 keep the mandrel flow slots 745 radially aligned with flow slots 732. Once the pins contact the ends of the key slots, one or more dogs 750 drop into a recess in the outer diameter of the mandrel to lock the inner orifice sleeve to the mandrel, thereby allowing the inner orifice sleeve to move with mandrel 620.

Figure 17A:
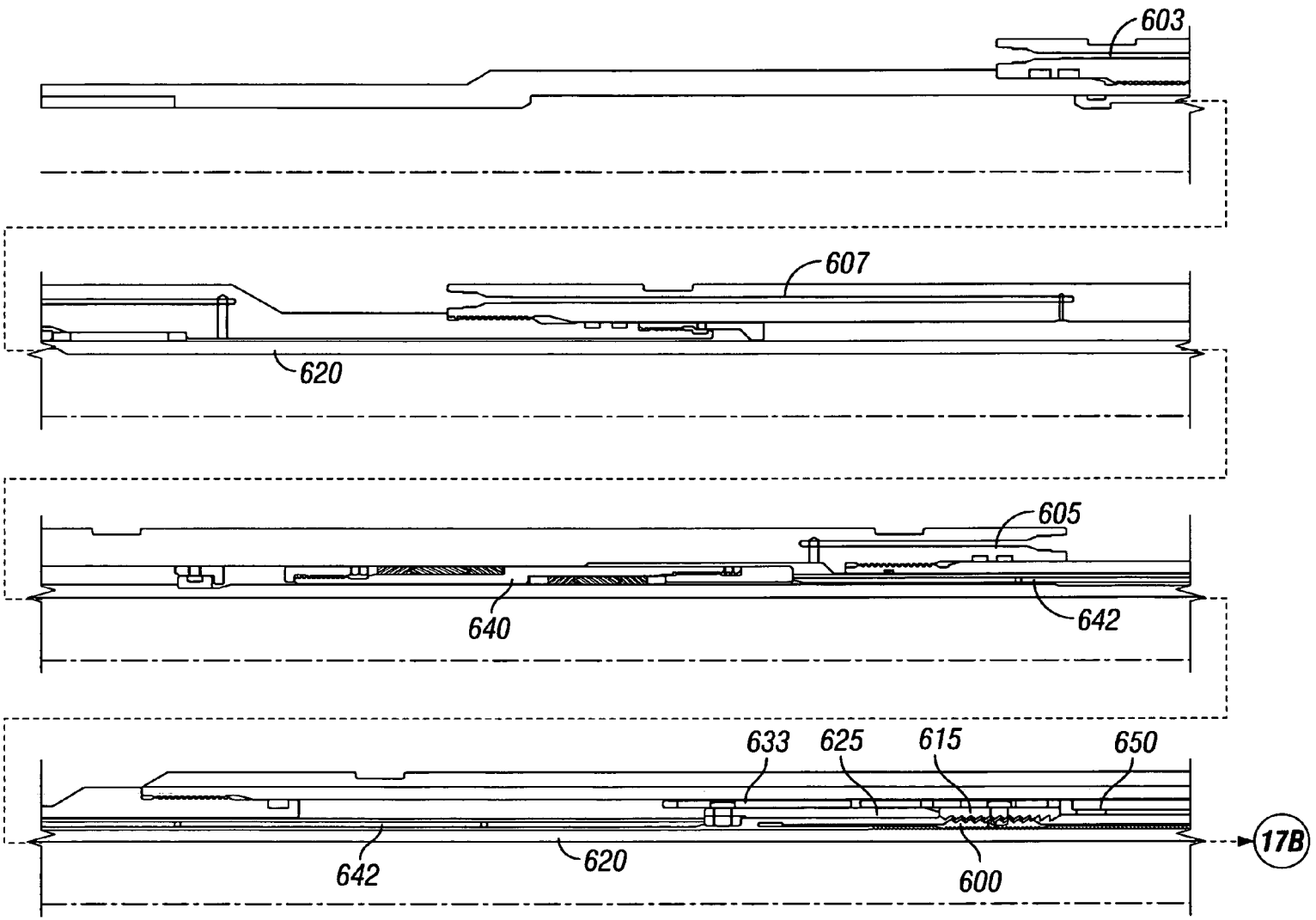
FIGS. 17A and 17B are a cross-section of the step ratchet mechanism of FIGS. 15A and 15B that has been cycled a number of times such that the flow orifice is in a fully opened position.
Figure 17B:
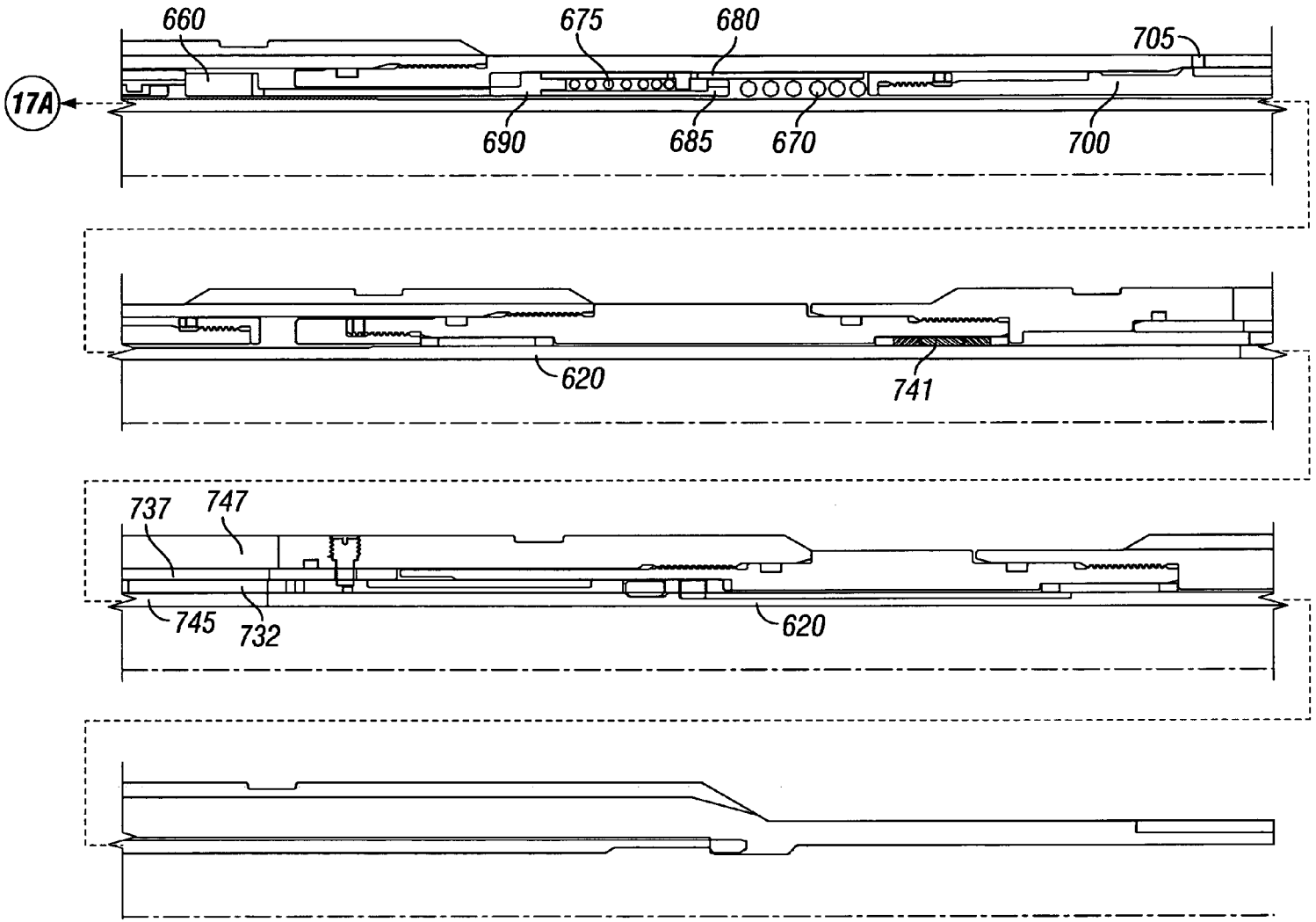
Figure 18A:
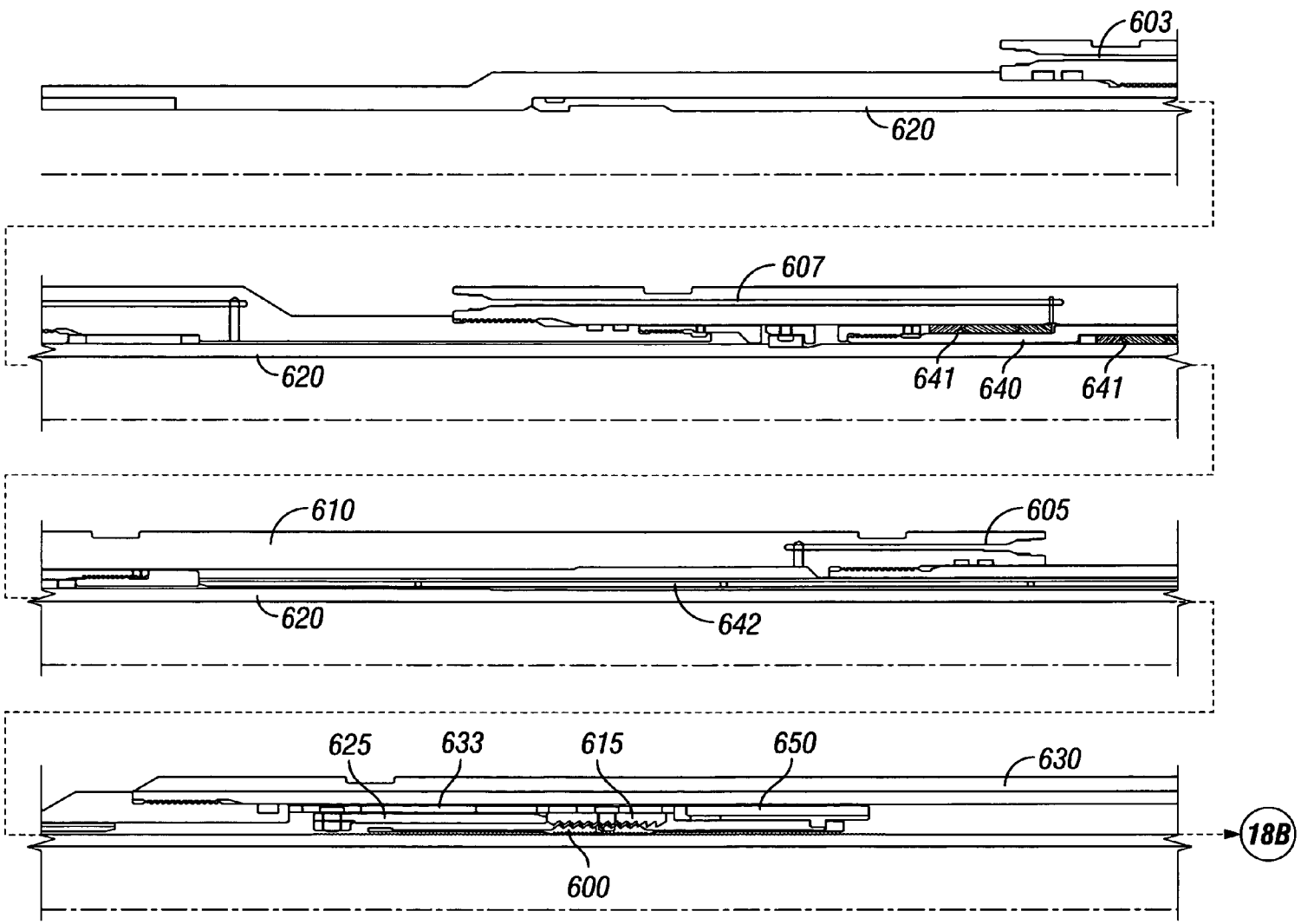
FIGS. 18A and 18B are a cross-section of the step ratchet mechanism of FIGS. 15A and 15B that has been returned to the initial position, thus closing the flow orifice.
Figure 18B:
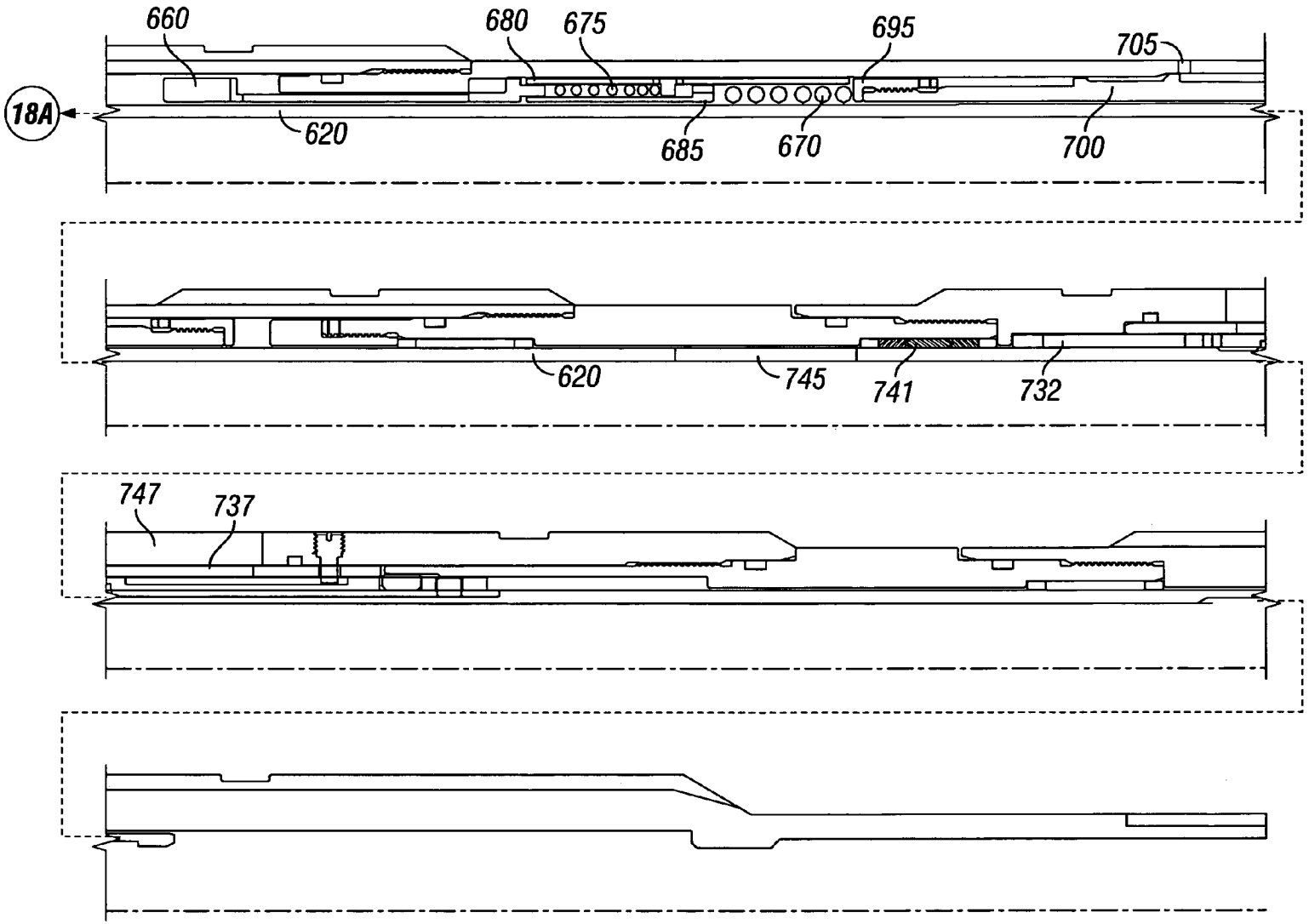

As the mandrel is incrementally moved downwardly, slots 732 in the inner orifice sleeve will gradually align with slots 737 in the outer orifice sleeve to allow flow through the adjustable orifice. Pin 755 prevents rotation between the outer housing and the inner and outer orifice sleeves to radially align flow ports 747, and slots 737 and 732. The size of the orifice may be adjusted to control the amount of flow through the orifice by incremental movement of the mandrel as described above. FIG. 17B illustrates the orifice in the fully opened position. The carbide inner and outer orifice sleeves provide wear resistance to fluid flow through the orifice.

In one embodiment, piston housing 610 may include an indicator port 607 which is in fluid communication with the piston chamber. A hydraulic connector is provided on the end of the port for a hydraulic line (not shown). The hydraulic line, along with a pressure relief valve, may be tied into the opening line to allow the indicator port to be used to monitor the position of piston 640 and mandrel 620. More particularly, when piston 640 is returned to its initial position, return line pressure will be felt at indicator port 607. When the return line pressure exceeds the opening pressure for the pressure relief valve, return line fluid can circulate from return port 605, through the piston chamber, into indicator port 602, through the pressure relief valve and up the opening control line to the surface, providing a positive indication that the piston is in its initial position and the adjustable orifice is in the closed position. The outer seal stack 641 on piston 640 will prevent the return line fluid from reaching the indicator port until the seal stack passes the port upon the piston's arrival at its initial position. The indicator port also provides a user with a way to circulate out any gas that may be in the hydraulic control lines for the system.

Although various embodiments have been shown and described, the invention is not limited to such embodiments and will be understood to include all modifications and variations as would be apparent to one skilled in the art.

What is claimed is:

1. A step ratchet mechanism adapted for moving a mandrel in a first direction and moving said mandrel in a second direction opposite of said movement in a first direction; said step ratchet mechanism comprising:

a. a mandrel with an outer diameter and an outer surface;

b. a top connector with a proximal and distal end and an inner diameter greater than the outer diameter of said mandrel, said top connector surrounding said mandrel thereby creating a chamber between said top connector and said mandrel;

c. an upper adapter connected to the proximal end of said top connector and adjacent to said mandrel, said upper adapter having a port in fluid communication with said chamber;

d. a lower adapter connected to the distal end of said top connector and adjacent to said mandrel, said lower adapter having a port in fluid communication with said chamber;

e. a moveable piston located within said chamber adjacent to said top connector and said mandrel, said moveable piston adapted to substantially prevent fluid communication between the port in said upper adapter and the port in said lower adapter through said chamber;

f. a locking mechanism having an inner and outer surface, said inner surface of said locking mechanism adapted to selectively engage said mandrel;

g. a locking mechanism carrier having an inner and outer surface, said inner surface of said locking mechanism carrier adapted to selectively engage the outer surface of said locking mechanism; and h. a spring located within a spring holder.

2. The step ratchet mechanism of claim 1 wherein said mandrel is operatively connected to one or more multi-position devices.

3. The step ratchet mechanism of claim 1 wherein said mandrel is operatively connected to at one or more adjustable orifices and associated fluid ports for said adjustable orifices.

4. The step ratchet mechanism of claim 3 wherein the movement of the mandrel permits incremental adjustment of the flow through said adjustable orifices.

5. The step ratchet mechanism of claim 1 further comprising a stop or catch on said mandrel located within said chamber.

6. The step ratchet mechanism of claim 5 wherein said stop or catch comprises a lock ring holder and a ratchet lock ring.

7. The step ratchet mechanism of claim 1 wherein said locking mechanism comprises a body lock ring having an inner and outer surface, said inner surface of said body lock ring adapted to selectively engage said mandrel and said locking mechanism carrier comprises a body lock ring carrier having an inner and outer surface, said inner surface of said body lock ring carrier adapted to selectively engage the outer surface of said body lock ring.

8. The step ratchet mechanism of claim 7 further comprising a body lock ring holder attached to the body lock ring and the body lock ring carrier.

9. The step ratchet mechanism of claim 7 wherein said body lock ring includes exterior teeth on the outer surface adapted to engage teeth located on the inner surface of the body lock ring carrier, said body lock ring further comprising interior teeth on the inner surface adapted to selectively engage teeth located on the outer surface of the mandrel, wherein said interior teeth of the body lock ring are adapted to selectively engage the teeth on the exterior of the mandrel in a first direction and to allow the body lock ring to move along the mandrel in a second direction.

10. The step ratchet mechanism of claim 9 wherein said body lock ring comprises a ring including a longitudinal gap in said ring.

11. The step ratchet mechanism of claim 9 wherein the exterior teeth of the body lock ring include a vertical face and an angled face and the interior teeth of the body lock ring include a first and a second angled face.

12. The step ratchet mechanism of claim 11 wherein a. the vertical face of the exterior teeth of the body lock ring is inclined between about 80 to 95 degrees from the horizontal plane of the exterior teeth of the body lock ring;

b. the first angled face of the interior teeth of the body lock ring is inclined less than or equal to about 70 degrees from the horizontal plane of the interior teeth of the body lock ring;

c. the angled face of the exterior teeth of the body lock ring is inclined from the horizontal plane of the exterior teeth of the body lock ring at an angle about 20 degrees less than the angle at which the first angled face of the interior teeth of the body lock ring is inclined from the horizontal plane of the interior teeth of the body lock;

d. the second angled face of the interior teeth of the body lock ring is inclined less than or equal to about 70 degrees from the horizontal plane of the interior teeth of the body lock ring; and e. the second angled face of the interior teeth of the body lock ring is inclined from the horizontal plane of the interior teeth of the body lock ring at an angle about 20 degrees less than the angle at which the vertical face of the exterior teeth of the body lock ring is inclined from the horizontal plane of the exterior teeth of the body lock ring.

13. The step ratchet mechanism of claim 1 wherein said locking mechanism comprises a body lock collet having an inner and outer surface, said inner surface of said body lock collet adapted to selectively engage said mandrel and said locking mechanism carrier comprises a body lock collet carrier having an inner and outer surface, said inner surface of said body lock collet carrier adapted to selectively engage the outer surface of said body lock collet.

14. The step ratchet mechanism of claim 13 further comprising a body lock collet holder attached to the body lock collet and the body lock collet carrier.

15. The step ratchet mechanism of claim 13 wherein said body lock collet includes exterior teeth on the outer surface adapted to engage teeth located on the inner surface of the body lock collet carrier, said body lock collet further comprising interior teeth on the inner surface adapted to selectively engage teeth located on the outer surface of the mandrel, wherein said interior teeth of the body lock collet are adapted to selectively engage the teeth on the exterior of the mandrel in a first direction and to allow the body lock collet to move along the mandrel in a second direction.

16. The step ratchet mechanism of claim 15 wherein the exterior teeth of the body lock collet include a vertical face and an angled face and the interior teeth of the body lock collet include a first and a second angled face.

17. The step ratchet mechanism of claim 16 wherein a. the vertical face of the exterior teeth of the body lock collet is inclined between about 80 to 95 degrees from the horizontal plane of the exterior teeth of the body lock collet;

b. the first angled face of the interior teeth of the body lock collet is inclined less than or equal to about 70 degrees from the horizontal plane of the interior teeth of the body lock collet;

c. the angled face of the exterior teeth of the body lock collet is inclined from the horizontal plane of the exterior teeth of the body lock collet at an angle about 20 degrees less than the angle at which the first angled face of the interior teeth of the body lock collet is inclined from the horizontal plane of the interior teeth of the body lock collet;

d. the second angled face of the interior teeth of the body lock collet is inclined less than or equal to about 70 degrees from the horizontal plane of the interior teeth of the body lock; and e. the second angled face of the interior teeth of the body lock collet is inclined from the horizontal plane of the interior teeth of the body lock collet at an angle about 20 degrees less than the angle at which the vertical face of the exterior teeth of the body lock collet is inclined from the horizontal plane of the exterior teeth of the body lock collet.

18. A step ratchet mechanism adapted for moving a mandrel in a first direction and moving said mandrel in a second direction opposite of said movement in a first direction; said step ratchet mechanism comprising:

a. a mandrel with an outer diameter and an outer surface and a longitudinal axis;

b. a top connector with a proximal and distal end and an inner diameter greater than the outer diameter of said mandrel, said top connector surrounding said mandrel thereby creating a chamber between said top connector and said mandrel;

c. an upper adapter connected to the proximal end of said top connector and adjacent to said mandrel, said upper adapter having a port in fluid communication with said chamber;

d. a lower adapter connected to the distal end of said top connector and adjacent to said mandrel, said lower adapter having a port in fluid communication with said chamber;

e. a moveable piston located within said chamber adjacent to said top connector and said mandrel, said moveable piston adapted to substantially prevent fluid communication between the port in said upper adapter and the port in said lower adapter through said chamber;

f. a double ended body lock collet having an inner and an outer surface, said inner surface of said a double ended body lock collet adapted to selectively engage said mandrel;

g. a body lock collet carrier having an inner and outer surface, said inner surface of said body lock collet carrier adapted to selectively engage the outer surface of said double ended body lock collet;

h. a spring having a proximal and a distal end and a longitudinal axis, wherein said longitudinal axis of the spring is substantially parallel to said longitudinal axis of the mandrel and said proximal end of the spring is relatively closer to the proximal end of the top connector than said distal end of the spring; and i. a cylinder adjacent to the proximal end of said spring.

19. The step ratchet mechanism of claim 18 wherein said a double ended body lock collet includes exterior teeth on the outer surface adapted to engage teeth located on the inner surface of the a double ended body lock collet carrier, said a double ended body lock collet further comprising interior teeth on the inner surface adapted to selectively engage teeth located on the outer surface of the mandrel, wherein said interior teeth of the a double ended body lock collet are adapted to selectively engage the teeth on the exterior of the mandrel in a first direction and to allow the a double ended body lock collet to move along the mandrel in a second direction.

20. The step ratchet mechanism of claim 19 wherein the exterior teeth of the double ended body lock collet include a vertical face and an angled face and the interior teeth of the double ended body lock collet include a first and a second angled face.

21. The step ratchet mechanism of claim 20 wherein a. the vertical face of the exterior teeth of the double ended body lock collet is inclined between about 80 to 95 degrees from the horizontal plane of the exterior teeth of the double ended body lock collet;

b. the first angled face of the interior teeth of the double ended body lock collet is inclined less than or equal to about 70 degrees from the horizontal plane of the interior teeth of the double ended body lock collet;

c. the angled face of the exterior teeth of the double ended body lock collet is inclined from the horizontal plane of the exterior teeth of the double ended body lock collet at an angle about 20 degrees less than the angle at which the first angled face of the interior teeth of the double ended body lock collet is inclined from the horizontal plane of the interior teeth of the double ended body lock collet;

d. the second angled face of the interior teeth of the double ended body lock collet is inclined less than or equal to about 70 degrees from the horizontal plane of the interior teeth of the double ended body lock collet; and e. the second angled face of the interior teeth of the double ended body lock collet is inclined from the horizontal plane of the interior teeth of the double ended body lock collet at an angle about 20 degrees less than the angle at which the vertical face of the exterior teeth of the double ended body lock collet is inclined from the horizontal plane of the exterior teeth of the double ended body lock collet.

22. The step ratchet mechanism of claim 18 wherein said mandrel is operatively connected to one or more multi-position devices.

23. The step ratchet mechanism of claim 18 wherein said mandrel is operatively connected to at one or more adjustable orifices and associated fluid ports for said adjustable orifices.

24. The step ratchet mechanism of claim 23 wherein the movement of the mandrel permits incremental adjustment of the flow through said adjustable orifices.

25. A step ratchet mechanism adapted for moving a mandrel in a first direction and moving said mandrel in a second direction opposite of said movement in a first direction; said step ratchet mechanism comprising:

a. a mandrel with an outer diameter and an outer surface;

b. a top connector with a proximal and distal end and an inner diameter greater than the outer diameter of said mandrel, said top connector surrounding said mandrel thereby creating a chamber between said top connector and said mandrel;

c. an upper adapter connected to the proximal end of said top connector and adjacent to said mandrel, said upper adapter having a port in fluid communication with said chamber;

d. a lower adapter connected to the distal end of said top connector and adjacent to said mandrel, said lower adapter having a port in fluid communication with said chamber;

e. a moveable piston having a proximal end and a distal end, said piston located within said chamber adjacent to said top connector and said mandrel, said moveable piston adapted to substantially prevent fluid communication between the port in said upper adapter and the port in said lower adapter through said chamber;

f. an upper locking mechanism connected to the proximal end of said piston, said upper locking mechanism having an inner and outer surface, said inner surface of said upper locking mechanism adapted to selectively engage said mandrel;

g. an upper locking mechanism carrier having an inner and outer surface, said inner surface of said upper locking mechanism carrier adapted to selectively engage the outer surface of said upper locking mechanism;

h. an upper spring located within an upper spring holder;

i. a lower locking mechanism connected to the distal end of said piston, said lower locking mechanism having an inner and outer surface, said inner surface of said lower locking mechanism adapted to selectively engage said mandrel;

j. a lower locking mechanism carrier having an inner and outer surface, said inner surface of said lower locking mechanism carrier adapted to selectively engage the outer surface of said lower locking mechanism; and k. a lower spring located within a lower spring holder.

26. The step ratchet mechanism of claim 25 wherein said mandrel is operatively connected to one or more multi-position devices.

27. The step ratchet mechanism of claim 25 wherein said mandrel is operatively connected to one or more adjustable orifices and associated fluid ports for said adjustable orifices.

28. The step ratchet mechanism of claim 27 wherein the incremental movement of the mandrel permits incremental adjustment of the flow through said adjustable orifices.

29. The step ratchet mechanism of claim 25 wherein said upper locking mechanism includes exterior teeth on the outer surface adapted to engage teeth located on the inner surface of the upper locking mechanism carrier, said upper locking mechanism further comprising interior teeth on the inner surface adapted to selectively engage teeth located on the outer surface of the mandrel, wherein said interior teeth of the upper locking mechanism are adapted to allow the locking mechanism to move along the mandrel in a first direction and to selectively engage the teeth on the exterior of the mandrel in a second direction and said lower locking mechanism includes exterior teeth on the outer surface adapted to engage teeth located on the inner surface of the lower locking mechanism carrier, said lower locking mechanism further comprising interior teeth on the inner surface adapted to selectively engage teeth located on the outer surface of the mandrel, wherein said interior teeth of the lower locking mechanism are adapted to selectively engage the teeth on the exterior of the mandrel in a first direction and to allow the locking mechanism to move along the mandrel in a second direction.

30. The step ratchet mechanism of claim 29 wherein the exterior teeth of the upper and lower locking mechanisms include a vertical face and an angled face and the interior teeth of the upper and lower locking mechanisms include a first and a second angled face.

31. The step ratchet mechanism of claim 30 wherein a. the vertical face of the exterior teeth of the upper and lower locking mechanisms is inclined between about 80 to 95 degrees from the horizontal plane of the exterior teeth of the upper and lower locking mechanisms;

b. the first angled face of the interior teeth of the upper and lower locking mechanisms is inclined less than or equal to about 70 degrees from the horizontal plane of the interior teeth of the upper and lower locking mechanisms;

c. the angled face of the exterior teeth of the upper and lower locking mechanisms is inclined from the horizontal plane of the exterior teeth of the upper and lower locking mechanisms at an angle about 20 degrees less than the angle at which the first angled face of the interior teeth of the upper and lower locking mechanisms is inclined from the horizontal plane of the interior teeth of the upper and lower locking mechanisms;

d. the second angled face of the interior teeth of the upper and lower locking mechanisms is inclined less than or equal to about 70 degrees from the horizontal plane of the interior teeth of the upper and lower locking mechanisms; and e. the second angled face of the interior teeth of the upper and lower locking mechanisms is inclined from the horizontal plane of the interior teeth of the upper and lower locking mechanisms at an angle about 20 degrees less than the angle at which the vertical face of the exterior teeth of the upper and lower locking mechanisms is inclined from the horizontal plane of the exterior teeth of the upper and lower locking mechanisms.

32. The step ratchet mechanism of claim 25 wherein said upper and lower locking mechanisms comprise body lock rings and wherein said upper and lower locking mechanism carriers comprise body lock ring carriers.

33. The step ratchet mechanism of claim 25 wherein said upper and lower locking mechanisms comprise body lock collets and wherein said upper and lower locking mechanism carriers comprise body lock collet carriers.

* * * * *